US009078494B2

(12) United States Patent
Pupko

(10) Patent No.: US 9,078,494 B2
(45) Date of Patent: Jul. 14, 2015

(54) SKI BOOTS AND OTHER SHOES AND METHOD FOR IMPROVED BALANCE

(76) Inventor: Michael M. Pupko, Colden, NY (US)

( * ) Notice: Subject to any disclaimer, the term of this patent is extended or adjusted under 35 U.S.C. 154(b) by 1582 days.

(21) Appl. No.: 12/229,720

(22) Filed: Aug. 26, 2008

(65) Prior Publication Data

US 2009/0071019 A1 Mar. 19, 2009

Related U.S. Application Data

(63) Continuation-in-part of application No. 11/412,807, filed on Apr. 27, 2006, now abandoned, and a continuation-in-part of application No. 12/152,456, filed on May 14, 2008, now Pat. No. 8,191,918, which is a continuation-in-part of application No. 10/530,859, filed as application No. PCT/US03/33107 on Oct. 17, 2003, now Pat. No. 7,387,309.

(60) Provisional application No. 60/680,232, filed on May 12, 2005, provisional application No. 60/419,186, filed on Oct. 17, 2003.

(51) Int. Cl.

| | |
|---|---|
| ***A43B 23/00*** | (2006.01) |
| ***A43B 5/04*** | (2006.01) |
| ***A43D 1/06*** | (2006.01) |
| ***A63C 9/00*** | (2012.01) |
| *A43D 1/02* | (2006.01) |

(52) U.S. Cl.

CPC ..... *A43D 1/02* (2013.01); *A43B 5/0439* (2013.01); *A43D 1/06* (2013.01); *A63C 9/003* (2013.01); *A63C 9/006* (2013.01)

(58) Field of Classification Search

CPC ..... A43D 1/02; A43D 1/06; A63D 1/003; A63D 9/006; A43B 5/0439

USPC ..... 600/592; 36/33, 97, 43, 44, 93; 12/36, 12/142 R

See application file for complete search history.

(56) References Cited

U.S. PATENT DOCUMENTS

| | | | | | |
|---|---|---|---|---|---|
| 2,330,317 | A | * | 9/1943 | Stewart | 33/3 A |
| 4,003,146 | A | * | 1/1977 | Meier et al. | 36/44 |
| 4,297,798 | A | * | 11/1981 | Colan | 36/101 |
| 4,802,494 | A | * | 2/1989 | Gardiner | 600/592 |
| 4,821,420 | A | | 4/1989 | Maykel | |
| 4,910,886 | A | * | 3/1990 | Sullivan et al. | 36/44 |
| 4,917,105 | A | * | 4/1990 | Tiitola et al. | 600/592 |
| 4,942,677 | A | * | 7/1990 | Flemming et al. | 36/27 |

(Continued)

OTHER PUBLICATIONS

Master Fit Enterprises, Masterfit University the Booffitters Bible—The Master's Course, 2003, pp. 9-14, Apr. 2003 edition, Briarcliff Manor, NY.

(Continued)

*Primary Examiner* — Sean Dougherty
*Assistant Examiner* — Michael C Stout
(74) *Attorney, Agent, or Firm* — James C. Simmons

(57) ABSTRACT

A shoe is tailored for a foot of a person by positioning the foot in a range of incremental heel to forefoot height differential positions, altering the sole of the shoe to have a heel to forefoot height differential which match one of the heel to forefoot height differentials which is determined for the foot to be optimum for mobility and/or flexion and/or balance, and forming an insole for the shoe which conforms to the altered sole.

A device in the form of a parallelogram for use with an inclinometer for measuring the angle of heel to forefoot height differential of a shoe.

1 Claim, 16 Drawing Sheets

(56) References Cited

U.S. PATENT DOCUMENTS

| | | | | |
|---|---|---|---|---|
| 5,426,871 | A * | 6/1995 | Spademan et al. | 36/118.8 |
| 5,544,432 | A * | 8/1996 | Kita | 36/43 |
| 5,580,070 | A * | 12/1996 | Bekessy | 280/11.27 |
| 5,782,015 | A * | 7/1998 | Dananberg | 36/34 R |
| 5,925,000 | A * | 7/1999 | Marciniak et al. | 600/592 |
| 5,941,835 | A | 8/1999 | Sundman | |
| 5,979,067 | A * | 11/1999 | Waters | 33/512 |
| 6,205,230 | B1 | 3/2001 | Sundman et al. | |
| 6,219,929 | B1 | 4/2001 | Tasker et al. | |
| 6,334,257 | B1 | 1/2002 | Den Ouden | |
| 6,493,958 | B1 * | 12/2002 | Tadin | 33/515 |
| 6,829,377 | B2 | 12/2004 | Milioto | |
| 7,125,509 | B1 | 10/2006 | Smith | |
| 7,335,167 | B1 | 2/2008 | Mummy | |
| 7,387,309 | B2 | 6/2008 | Pupko | |
| 2002/0046472 | A1 * | 4/2002 | Tadin | 33/515 |
| 2003/0019130 | A1 * | 1/2003 | Renegar | 36/127 |
| 2004/0193075 | A1 | 9/2004 | Martindale | |
| 2005/0262736 | A1 * | 12/2005 | Peoples | 36/44 |
| 2006/0030793 | A1 | 2/2006 | Granata et al. | |
| 2006/0225297 | A1 | 10/2006 | Tadin et al. | |
| 2006/0230638 | A1 * | 10/2006 | Cavasin | 36/117.3 |
| 2006/0277772 | A1 * | 12/2006 | Pupko | 33/3 R |
| 2007/0163150 | A1 * | 7/2007 | Yang | 36/108 |
| 2008/0028625 | A1 * | 2/2008 | Nudelman et al. | 33/515 |
| 2008/0229614 | A1 * | 9/2008 | Santa Ana | 36/100 |
| 2008/0276476 | A1 * | 11/2008 | Stephen et al. | 33/515 |
| 2008/0290630 | A1 | 11/2008 | Pupko | |
| 2009/0208113 | A1 * | 8/2009 | Bar | 382/199 |
| 2010/0069807 | A1 * | 3/2010 | Cox | 602/23 |
| 2012/0061945 | A1 * | 3/2012 | Korich | 280/617 |

OTHER PUBLICATIONS

W. Witherell, The Athletic Skier, 1993, pp. 21-44, The Athletic Skier Inc., Salt Lake City, Utah.

Prime Materials Corporation, Treadeasy Catalog 08-09, 2008, pp. 19.

Tecnica, Vento Instruction Manual, 10 unnumbered English language pages, 2005, Italy.

* cited by examiner

FIG. 5
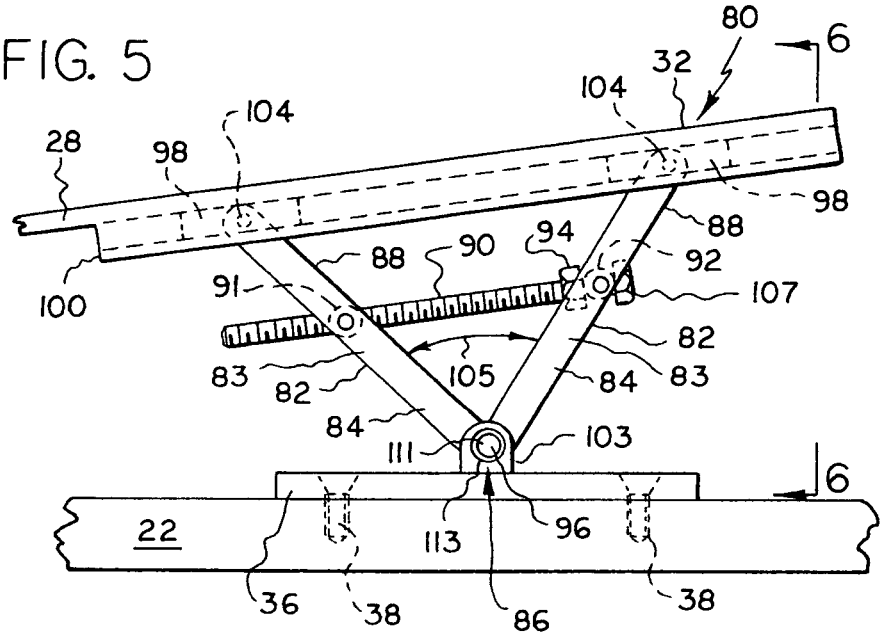
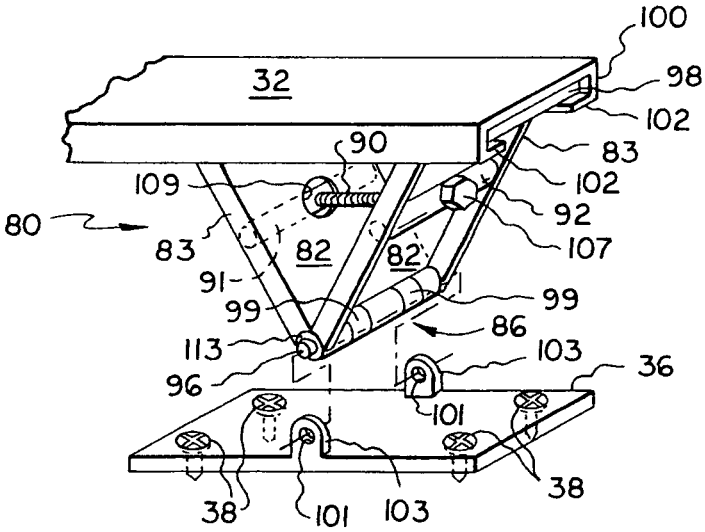
FIG. 6
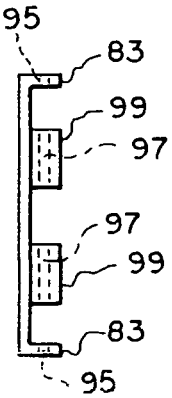
FIG. 6A

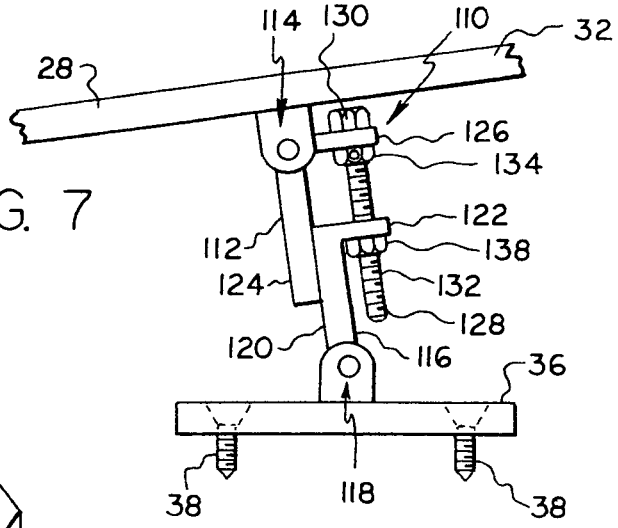
FIG. 7
FIG. 8
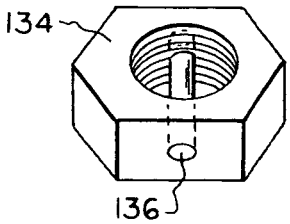
FIG. 9
PRIOR ART
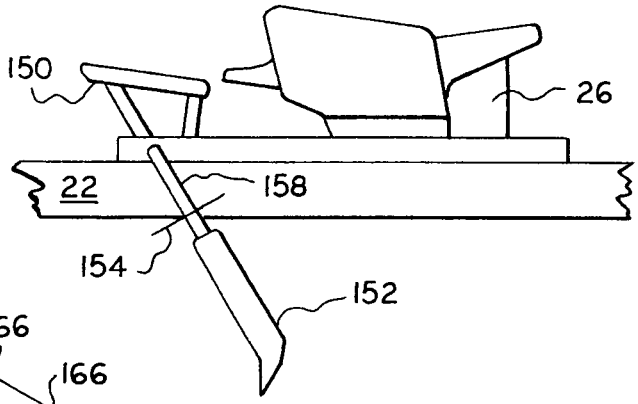
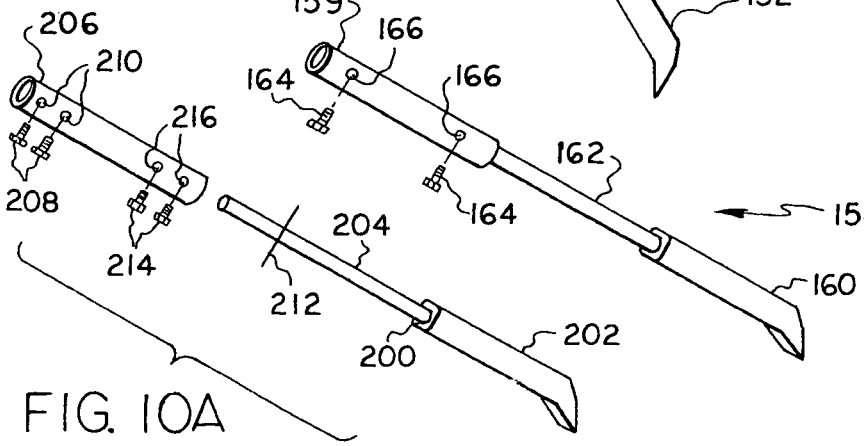
FIG. 10
FIG. 10A FIG. 38
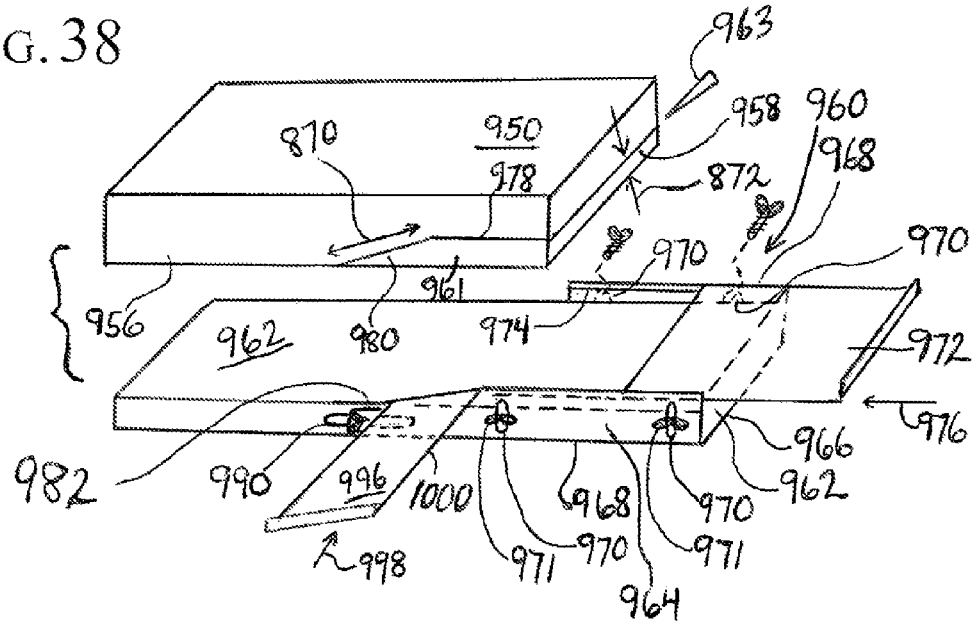
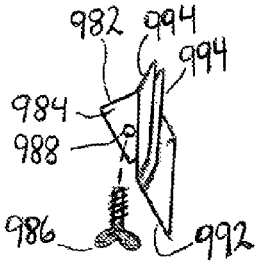
FIG. 39
FIG. 40
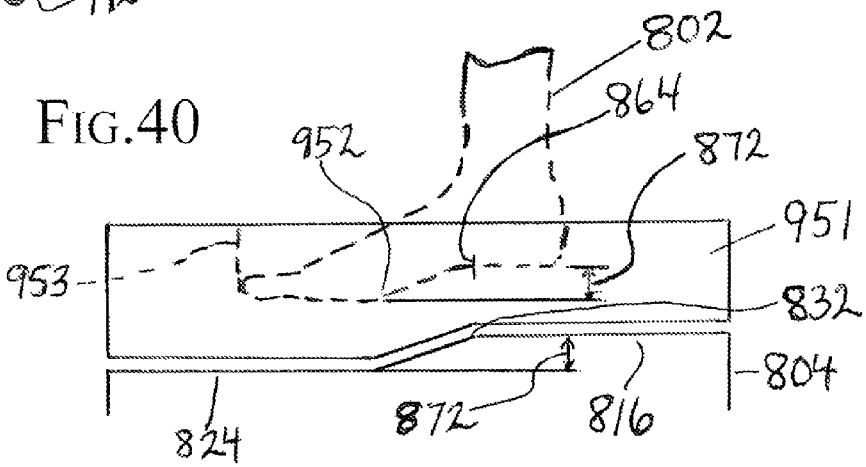

SKI BOOTS AND OTHER SHOES AND METHOD FOR IMPROVED BALANCE

This is a continuation-in-part of U.S. patent application Ser. No. 11/412,807, filed Apr. 27, 2006, now abandoned which claims priority of U.S. provisional patent application Ser. No. 60/680,232, filed May 12, 2005, and such priority is hereby claimed, and this is also a continuation-in-part of U.S. patent application Ser. No. 12/152,456, filed May 14, 2008, now U.S. Pat. No. 8,191,918 which is a continuation-in-part of U.S. patent application Ser. No. 10/530,859, filed Apr. 8, 2005 (national stage of international application PCT/US2003/033107, filed Oct. 17, 2003) (now U.S. Pat. No. 7,387,309, issued Jun. 17, 2008), which claims priority of U.S. provisional patent application Ser. No. 60/419,186, filed Oct. 17, 2003, and such priority is hereby claimed. The disclosures of all of the above applications, as well as all patents/published applications disclosed herein, are hereby incorporated herein by reference.

The present invention relates generally to ski boots and other shoes or footwear (for example, work shoes, sneakers, roller blades, and ice skates) as well as the attachment of ski boots to skis. More particularly, the present invention relates to the sizing of the footwear to achieve improved balance and/or mobility and/or flexion as well as the attachment of ski boots to skis to achieve improved balance.

Typical ski equipment set-ups leave many people in very poor fore/aft positions, i.e., leaving many people inclined too far backward. This makes it difficult to balance with the result that it is harder to learn to ski, with more tiring and an increased risk of injury. To achieve better balance, the skier's feet should often be inclined relative to the skis so that the heel portion of a ski boot is raised relative to the height of the toe portion thereof. The correct fore and aft position will vary depending on the skier's body type. It is thus considered desirable for a skier to be able to adjust his or her fore and aft position (i.e., adjust the height of the heel end portion of the ski boot) to achieve the correct balance for him or her. Such an adjustment may be characterized as an adjustment of the angle of the leg relative to the ski or ground.

Various devices of interest relative to adjusting the heel portion height are disclosed in my aforesaid patent as well as in the art cited therein.

Additional art which may be of interest (generally relative to foot contour, as discussed hereinafter) to the present invention includes U.S. patents/published applications U.S. Pat. Nos. 4,821,420; 5,941,835; 5,979,067; 6,205,230; 6,219,929; 6,334,257; 2004/0193075; 6,829,377; 2006/0030793; 7,125,509; 2006/0225297; and 7,335,167. The hoof angles of horses have been modified by trimming the hoofs.

As discussed at pages 10 to 14 of the booklet *Masterfit University the Bootfitters Bible—The Master's Course*, Master Fit Enterprises, Briarcliff Manor, N.Y., 1994-2003, the foot has a very intricate network of 26 bones which slip and slide relative to each other. When performing properly, these bones allow very intricate movements easily of the foot. However, if not suitably positioned relative to each other, these bones may also collide with each other or jam together, resulting in trauma such as callus formation and may result in loss of optimum mobility and/or flexion and/or balance. This booklet recommends orthotics and custom footpads for callus formations and, in severe cases, a metatarsal pad and/or a depression. Other suggested solutions include adjusting for pronation with custom footbeds or varus wedges and to use thicker insole and/or eliminator to compensate for a low volume foot. Motions in a group of bones known as the subtalar-transverse tarsal joint complex are said to allow the foot to absorb impacts, accommodate for uneven surfaces, and act as a rigid lever, and it is in this complex where locking and unlocking of the foot may commonly occur. It is thus important that the foot bones be properly positioned relative to each other to achieve optimum movements while skiing or otherwise. While adjustment of the relationship of the leg relative to the ski or ground for improved balance is important, as discussed above, it is also considered important that optimum positioning of the foot bones relative to each other be achieved. Optimum positioning of the foot bones relative to each other is generally related to the contour of the footboard or footbed or bootboard, i.e., the upper surface of the sole or built-up sole within a piece of footwear upon which the foot or an insole rests, an insole being a removable piece (on which the foot rests) which is placed to lie over the sole generally for comfort.

In W. Witherell et al, *The Athletic Skier*, The Athletic Skier, Inc., Salt Lake City, Utah, 1993, at pages 24 to 44, it is discussed that the desired heel lift (the difference between the heel and forefoot levels) significantly affects fore and aft balance, that some feet are best balanced and aligned when the heel and forefoot are on the same plane while others are best balanced and aligned when the heel is higher than the forefoot. Also discussed therein is a way of measuring a person's heel to forefoot differential by having the person stand on various thicknesses of stacks of paper and then the person sensing their balance, i.e., when the right balance is achieved, "your body will know (the human body senses balance very precisely)." A heel lift under the heel is shown on page 26 thereof. On page 33 thereof, a photo of feet with the left foot supinated and the right foot pronated is shown and another photo is shown with the feet well aligned with proper orthotics. An adjustable cuff is discussed on pages 42 to 44 wherein, after the footbeds or orthotics are put into the boots, the cuff is adjusted so that the space between the leg and shell is equal on both sides.

*The Athletic Skier* fails to disclose or suggest suitable methods or measuring devices to accurately determine the needs of a person's foot and determine accurately what suitable angles/contours should be on the surface (footboard or footpad) in the footwear that the foot rests upon. For example, one thing this reference fails to take into consideration is that, as the heel to forefoot differential changes, so too does the contour of the foot's arch.

Heel lifts of varying thicknesses and tapers are marketed by Aetrex Worldwide, Inc. of Teaneck, N.J. (www.aetrex.com) and Ski-Kare of Golden, Colo. Aetrex Worldwide, Inc. claims to have patented what it calls the "iStep Evolution-RX" digital foot scanning technology, which it says on its website is in order to help consumers identify their arch type, shoe size, and pressure points and to custom select/order the ideal footwear and orthotics, including insoles, for their feet. The footwear is custom made from the digital information.

A lift to accommodate leg length discrepancy up to ⅜ inch (it has 3 layers with instructions to peel away one layer for ¼ inch or two layers for ⅛ inch), finished with a leather cover, is marketed, under the name Adjust-a-Lift, and under the trade name Treadeasy by Prime Materials Corporation of Batavia, N.Y. See their Treadeasy Catalog 08-09 at page 19 (or see their web page at www.treadeasy.com—under Product Catalog, Materials, Metatarsal Supports, Adjust-a-Lift).

The heel lifts are typically placed between the heel and the insole. The thicker part of a wedge-shaped or tapered heel lift is typically placed toward the rear. Typically, a person is instructed to put a heel lift in, go skiing, and leave the heel lift in if the skiing is improved.

The cuff is typically attached to the shell of a ski boot with cammed fasteners or knobs or studs, such as in the Vento ski boot marketed by the Italian company Technica, having a web site of www.technica.it, which are advertised (Technica, Vento Instruction Manual) to allow longitudinal flex of the boot to be adjusted and to allow the cuff to be adjusted from a neutral position to an inwards or outwards tilt. The boot is further advertised (in the above instruction manual) as having an upper liner construction to ensure perfect adaptation to the female calf and to have a patented ratchet system that may be adjusted to 3 different positions to adapt to any type of leg. The boot is further advertised (in the above instruction manual) as providing a specific insert to be applied onto a wedge inside the shell so that the fit in the heel area may be customized more to the female anatomy. Such flex and tilt adjustments may have the incidental consequence merely as a result of their functioning of effecting a small movement of the cuff 710 vertically relative to the shell 702 of typically less than about ¼ inch.

If a foot orthotic insole is made flat and then placed in footwear with a raised footboard in the heel area, the insole may no longer follow the foot's contour correctly and may accordingly still result in jammed foot bones, thus not suitably correcting the balance and/or mobility and/or flexion.

An insole may typically be custom made to fit the impression of the foot from a custom insole blank, which is a flat flexible or cushion sheet of uniform thickness which may have an underlying more rigid thin sheet for the heel and arch to hold the form in these areas (or the more rigid sheet may extend all the way to the toe area). In order to custom form the sheet, the foot is first placed into a beaded bladder (or other form) to form an impression of the foot lower surface. Then the sheet is suitable heated such as by placing in hot water or in an oven at a recommended temperature (for example, about 180 degrees F.) so that it may be conformable, and the conformable blank is then put into the impression and allowed to cool, thus taking on the shape of the foot lower surface. Undesirably, such a custom made insole for a orthotically lifted heel still may not conform properly with the thusly altered sole and may accordingly still result in jammed foot bones, thus not suitably correcting the balance and/or mobility and/or flexion.

It is accordingly an object of the present invention to accurately determine the foot's optimum position and to provide an insert or inserts or otherwise adjust the footboard so that it receives the foot in that optimum position.

It is another object of the present invention to prepare or adjust the footboard so that it follow's the foot's contour correctly.

It is a further object of the present invention to conform an insole to the altered footboard to properly correct balance and/or mobility and/or flexion.

It is yet another object of the present invention to optimize mobility and flexion and balance in skiers as well as other persons.

It is still another object to more easily determine heel to forefoot height differential and heel angle in footwear.

It is another object of the present invention to mass market a higher quality of shoes.

The above and other objects, features, and advantages of the present invention will be apparent in the following detailed description of the preferred embodiments thereof when read in conjunction with the appended drawings in which the same reference numerals depict the same or similar parts throughout the several views.

BRIEF DESCRIPTION OF THE DRAWINGS

FIG. 5 is a view similar to that of FIG. 1 of a ski binding in accordance with another alternative embodiment of the present invention.

FIG. 6 is a view thereof taken along lines 6-6 of FIG. 5.

FIG. 6A is a top view of one of a pair of brackets for the ski binding of FIG. 5.

FIG. 7 is a view similar to that of FIG. 1 of a ski binding in accordance with another alternative embodiment of the present invention.

FIG. 8 is a perspective view of a nut used in the binding of FIG. 7.

FIG. 9 is a schematic view showing a conventional ski brake for the ski.

FIG. 10 is a perspective view of an attachment to the ski brake for use when using the present invention.

FIG. 10A is a view similar to that of FIG. 10 of an alternative embodiment of the attachment.

FIG. 38 is a perspective view of a foam casting block and of a device for preparing the foam casting block for making an insert for tailoring the boot and illustrating how the foam casting block is prepared for making the insert.

FIG. 39 is a detail view of a portion of the device of FIG. 38.

FIG. 40 is a side view of the foam casting block lying on the apparatus (shown schematically) of FIG. 29 and illustrating in phantom lines the making of an impression of the lower surface of the foot in the casting block.

DETAILED DESCRIPTION OF THE PREFERRED EMBODIMENTS

Height adjustment on a ski of the heel end portion of a ski boot relative to the toe end portion thereof is discussed hereinafter with reference to FIGS. 1 to 26.

Figures 1, 2, 3, 4:
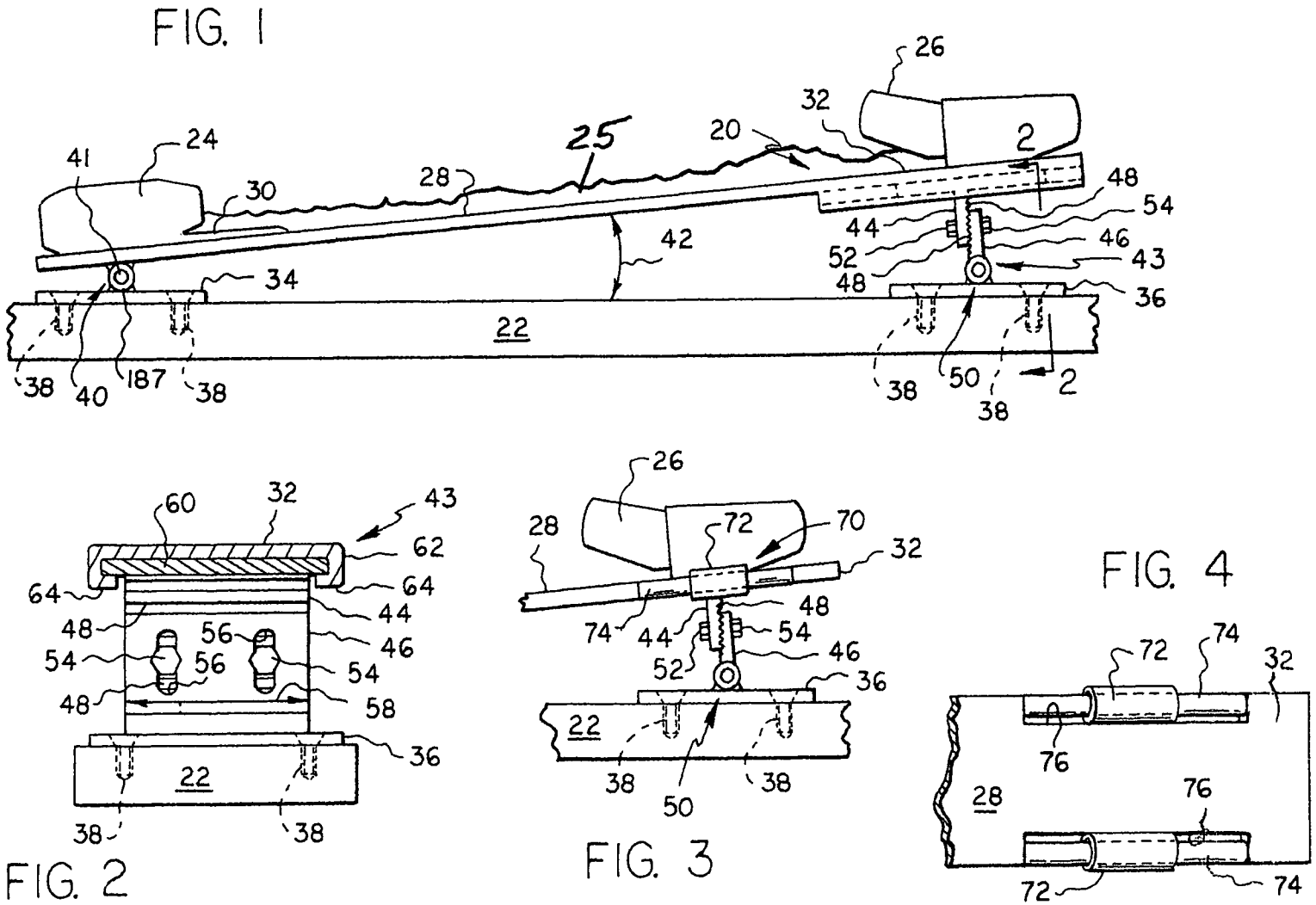
FIG. 1 is a side schematic view of a ski binding, with a boot schematically shown attached to the binding, according to the present invention.
FIG. 2 is a view thereof taken along lines 2-2 of FIG. 1.
FIG. 3 is a partial view similar to that of FIG. 1 of a ski binding in accordance with an alternative embodiment of the present invention.
FIG. 4 is a partial perspective view of the boot plate thereof.

Referring to FIGS. 1 and 2, there is shown generally at 20 a mechanism attaching a boot, illustrated at 25, to a ski 22, the toe and heel binding being conventional and illustrated at 24 and 26 respectively and corresponding to the toe and heel portions respectively of the boot 25. It is of course to be understood that the attachment of a boot to a ski, in accordance with the present invention, is via the use conventionally of bindings, as discussed hereinafter.

The mechanism 20 includes an elongate plate 28 to which the bindings 24 and 26 are suitably and conventionally attached in accordance with principles commonly known to those of ordinary skill in the art to which the present invention pertains, the plate 28 having a toe end portion 30 to which the toe binding 24 is attached and a heel end portion 32 to which the heel binding 26 is attached. The plate 28 has a width and length equal generally to the width and length of the bindings for the boot 25 to be bound thereto (which is generally equal to the width and length of the boot).

For purposes of providing a means for attachment of the elongate plate end portions 30 and 32 to the ski 22, as hereinafter discussed, corresponding plates 34 and 36 respectively are fixedly attached to the ski 22 such as by screws 38 or other suitable means. The width of each of the plates 34 and 36 is generally equal to the width of the elongate plate 28, and the length of each of the plates 34 may, for example, be generally equal to the width thereof, or otherwise as suitable. Each plate 34 and 36 may, for example, have 4 of the screws 38, one at each corner, or other suitable number of screws.

The toe end portion 30 is pivotally connected to the plate 34 by a conventional pivot or hinged connection, illustrated at 40, including a hinge pin 41, to allow the elongate plate 28 to be adjusted through the angle illustrated at 42 so that the height of the skier's heel relative to the skier's toes may be adjusted to achieve the optimum balance for the particular skier. The hinged connection 40 may, for example, be similar to the hinged connection illustrated in the aforesaid U.S. Pat. No. 4,353,575 and discussed at column 3, lines 1 to 5, thereof, which patent is hereby incorporated herein by reference. For another example, the hinged connection may be similar to a conventional door hinge, such as shown at 86 in FIGS. 5 and 6. In order to accommodate most skiers, the angle 42 is preferably adjustable up to at least about 10 degrees.

In order to provide an easy to use, stable, uncomplicated, reliable means for adjustment of the height of the heel end portion 32 relative to the toe end portion 30 through the angle 42, in accordance with the present invention, a height adjustment assembly, illustrated generally at 43, is provided wherein the heel end portion 32 is attached to the ski plate 36 by upper and lower members 44 and 46 respectively having complementary teeth or serrations, illustrated at 48, on facing sides for interlockingly engaging each other. The lower serrated member 46 is pivotally attached to ski plate 36 by a conventional pivot or hinged connection, illustrated at 50, which may be similar to hinged connection or otherwise as suitable. The upper serrated member 44 is attached to the elongate plate heel end portion 32 as hereinafter discussed. The members 44 and 46 are fixedly attached at an adjusted position by at least one but preferably a pair of bolts 52 and corresponding nuts 54 or other suitable fasteners, the shanks of the bolts 52 received in apertures (not shown) in member 44 and in vertically elongated adjustment slots, illustrated at 56, in the other member 46. It should be evident that the adjustment slots 56 may be provided in either of the members 44 and 46 and that the bolts 52 and nuts 54 may be interchanged. It should also be understood that either the bolt heads or the nuts may desirably be conventionally fixed to the respective member so as to be free from turning thereby making height adjustment easier for the skier. The width, illustrated at 58, of each of the members 44 and 46 is generally equal to the width of the elongate member 28 to thereby provide stability. Thus, it can be seen that the members may be attached by the bolts 52 and nuts 54 at any of various heights to which the heel portion 32 is to be desirably adjusted, with the serrations 48 on the upper member 44 bearingly and interlockingly engaging the complementary serrations 48 on the lower member 46 to stably provide the needed support. The serrations 48 are desirably sized, in accordance with principles commonly known to those of ordinary skill in the art to which the present invention pertains, to provide height adjustments of, for example, as little as ⅛ degree.

It is important that the ski 22 be able to flex as much as possible to make turning easier, and modern skies are typically constructed to maximize their flexing ability. During flexing of the ski, the distance between the plates 34 and 36 varies. In order to compensate for this variance in distance so that the ski 22 may be enabled to sufficiently flex as well as to evenly flex, the upper serrated member 44 is slidably attached to the heel portion 32 by an overhanging upper portion 60 of upper member 44 which is slidably received in a track, illustrated at 62, on the lower surface of heel portion 32. The track 62 comprises a pair of underhang portions 64 which are spaced apart a distance which is less than the width of the member overhanging portion 60 so that the portion 60 is retained slidably within the track 62. The track 62 may be open-ended at one or both ends to allow the member portion 60 to be inserted into the track 62 and is desirably long enough so that the member portion 60 does not come out of the track 62 during skiing.

In order to adjust the angle 42 so as to adjust the height of the skier's heel relative to the toes for improved balance as well as to achieve increased leverage, even while on the ski slopes, the skier may easily and quickly loosen the nuts 54, incrementally raise or lower the upper member 44 relative to the lower member 46, tighten the nuts 54 on the bolts 52 to firmly secure the members 44 and 46 in the newly adjusted position, and then go about enjoying skiing even more at the improved balance and leverage and with the upper member portion 60 sliding within the track 62 so that flexing of the ski for better turning is not unduly hampered.

It should be understood that the boot and ski plates 28, 34, and 36 are not essential to the present invention and that the toe binding 24 may be directly or otherwise pivotally connected to the ski 22 and the serrated members 44 and 46 directly or otherwise connected to the heel binding 26 and ski 22 respectively. The device of the present invention need not be a separate device but may instead be built into the ski and/or binding. Thus, a reference to the toe or heel end portion or to a ski in the claims is meant to also refer to plates attached or attachable thereto.

Referring to FIGS. 3 and 4, there is shown generally at 70 an alternative embodiment of the height adjustment assembly. The assembly 70, like the assembly 43 of FIGS. 1 and 2, comprises upper and lower serrated members 44 and 46 respectively attached by fasteners 52 and 54 and with the lower serrated member 46 pivotally mounted to the ski plate 36. In accordance with this alternative embodiment, the upper serrated member 44 is slidably attached to the heel end portion 32 of the boot plate 28 by a pair of tubular portions 72 suitably formed or otherwise attached on opposite sides respectively of the upper serrated member 44 and a pair of round rods 74 suitably formed or otherwise attached in cutouts 76 respectively on opposite sides respectively of the heel end portion 32 of the boot plate 28 and which are slidably received in the tubular portions 72 respectively.

Referring to FIGS. 5, 6, and 6A, there is shown generally at 80 an alternative embodiment of the height adjustment assembly. The assembly 80 comprises a pair of channel members 82 having side flanges 83 and the lower end portions 84 of which are pivotally attached to the ski plate by a suitable conventional pivot or hinge assembly 86, which is shown to be similar to a conventional door hinge. Thus, a hinge pin or pivot rod 96, providing a common pivot axis, is suitably received in apertures, illustrated at 95, in the side flanges 83 of each of the members 82 and in apertures, illustrated at 97, in alternate eyelet or tubular portions 99 on the bottom edges of the members 82, and at each end the hinge pin 96 is received in apertures, illustrated at 101, in eyelet members 103 which are welded or otherwise suitably attached to plate 36. The pin 96 is desirably (but not required to be) secured against removal from the hinge by suitable means such as, for example, a head 111 and washer 113 on one end and a nut (not shown) and washer (not shown) at the other end. Thus, the structural members 82 may be pivotally spread apart or contracted, as illustrated at 105 in FIG. 5, by pivotal movement on the hinge pin 96.

The upper end portions 88 of the members 82 are attached to the heel end portion 32 of plate 28, as hereinafter discussed. Intermediate the height of the members 82, elongate members 91 and 92 such as bars or tubular members are mounted to extend between the respective flanges 83 of the members 82 respectively and are suitably attached to the respective flanges 83 such as by screws (not shown) so that they can pivot (i.e., are rotatable about the longitudinal axis). The head end portion 107 of an adjustment bolt or screw 90 is received in an unthreaded aperture in member 92 and a nut 94, similar to nut 134 in FIG. 8, placed thereon so that the screw 90 rotates in place with the member 92 sandwiched between the bolt head and the nut 94. The screw 90 is threadedly received in a threaded aperture centrally located in rotatable member 91 to draw the members together or apart, as illustrated at 105) to increase or decrease respectively the distance between the plates 28 and 36 and thereby adjust the heel height, the members 91 and 92 being rotatable (pivotal) to allow alignment of the apertures therein during adjustment. Suitable openings, illustrated at 109 for one of the channel members, are provided in the channel members 82 for unfettered passage of the screw 90. The upper portion 88 of each of the members 82 is pivotably attached to an overhanging member 98 by means of a pin 104 or other suitable pivoting device. In order to allow the ski 22 to be able to sufficiently flex, these upper portions 88, similarly as shown in FIG. 2, are slidably attached to the heel portion 32 by the pivotally-connected overhanging members 98 being slidably received in a track, illustrated at 100, on the lower surface of heel portion 32. The track 100 comprises a pair of underhang or rail portions 102 which are spaced apart a distance which is less than the width of each of the overhanging members 98 so that the overhanging members 98 are retained slidably within the track 100. The track 100 may be open-ended at one or both ends to allow the members 98 to be inserted into the track 100 and is desirably long enough so that the members 98 do not come out of the track 100 during skiing.

The placement of an adjustment screw so that it is rigidly attached to the ski at the ski end of the "scissors" members, as in the aforesaid U.S. Pat. No. 4,007,946, detracts from the ability of the ski to flex as needed. Thus, in accordance with the present invention, the hinge 86 is instead placed at the ski plate 36. In order to provide increased stability, the "scissors" members 82 have a width which is generally equal to the width of each of plates 28 and 36.

The present invention is not limited to the particular components for the height adjustment assembly, which components are disclosed for exemplary purposes only. Thus, the present invention may be otherwise embodied for providing the desired height adjustment while allowing the ski to suitably flex. For example, the member 82 on the right side in FIGS. 5 and 6 may be removed, its corresponding elongate member 92 suitably mounted to the track 100 (or plate 32) so that it can pivot (i.e., rotate about its longitudinal axis), and elongate member 91 positioned to also serve as pin 104. This alternative assembly would thus allow pivoting at 104 and at the hinge 86 for height adjustment while also still allowing the ski to suitably flex.

Referring to FIGS. 7 and 8, there is shown generally at 110 an alternative embodiment of the height adjustment assembly. The assembly 110 comprises a member 112 pivotally mounted at pivot assembly 114 to the boot plate end portion 32 and another member 116 pivotally mounted at pivot assembly 118 to the ski plate 36. The pivot assemblies 114 and 118 may each be similar to hinge 50. Member 116 has a portion 120 which extends upwardly from hinge 116 to a point midway between the plates 28 and 36 and a portion 122 extends therefrom generally normal thereto. Member 112 is similarly shaped; a portion 124 terminates at a point midway between the plates 28 and 36 and has a track (not shown) on each side (similar to track 100 in FIGS. 5 and 6) in which is slidably received member 116 to act as a backing or support for member 116 to thereby provide increased stability, and another portion 126 extends from the hinge 114 and generally normal to portion 124. Thus, as seen in FIG. 7, the portions 122 and 126 are generally parallel to each other and spaced vertically so that by drawing them together or apart the heel height may be adjusted. Adjustment is provided by a pair of bolts or screws 128 (one on each side, only one shown) having a head 130 and the shank 132 of which is received in an aperture in portion 126 and a nut 134 applied thereto so that the portion 126 is disposed between the bolt head 130 and the nut 134. The nut 134, as seen in FIG. 8, has a roll pin 136 which passes centrally through the nut (normal to the nut axis) and is received in an aperture in the shank 132 whereby the bolt 128 cannot be moved axially but can be turned for providing height adjustment. The shank 132 is threadedly received in a threaded aperture in the portion 122. A locknut 138 is provided on the shank 132 to lockingly bear against the underside of the portion 122. Thus, by turning the bolt head 130, the vertical distance between the portions 122 and 126 may easily, even while on the ski slopes, be increased or decreased to adjust the heel height. Each of the members 112 and 116 has a width generally equal to that of plates 28 and 36 to provide good stability. Since it is envisioned that the assembly 110 may be difficult to mount as shown, it is believed that it may be more easily mounted at the rear edge of plate 28.

FIG. 9 shows a conventional ski brake 150 applied to the ski 22. When the heel height is adjusted as described herein, the ground engaging portion 152 of the brake 150 may be too high. In order to accommodate for the increased height, in accordance with the present invention, the portion 152 is cut off, as illustrated at 154, and an adaptive ground engaging portion, illustrated generally at 156 in FIG. 10, applied to the shank 158 of the brake 150. The adaptive portion 156 comprises a tubular portion 159 in which the shank 158 is received, a ground engaging portion 160, which is similar to the cut-off portion 152, and a shank portion 162 for increasing the overall shank length to thereby position the ground engaging portion 160 lower to compensate for the increased heel height. The tubular portion 159 is suitably attached to the shank portion 158 by a pair of axially spaced screws 164 received in apertures 166 in the tubular portion 159 and screwed into the shank portion 158 or by other suitable means. The length of the shank portion 162 may, for example, be about 2 inches.

Referring to FIG. 10A, in accordance with an alternative embodiment of the present invention, in order to provide for adjustment of the length of the shank portion 162 to allow more precise brake height adjustment, an adapter member 200 having a ground engaging portion 202 and a shank portion 204 is attached to the shank portion 158 by a separate tubular portion 206. The term "ground," as used herein and in the claims, is meant to include "snow." One end of the tubular portion 206 is slipped over the remaining shank portion 158 and attached thereto by a pair of axially spaced screws 208 received in apertures 210 respectively in the separate tubular portion 206 and screwed into the shank portion 158 or by other suitable means. The shank portion 204 is cut, as illustrated at 212, to achieve the desired brake length, and the remainder of the shank portion 204 is then received in the other end of the tubular portion 206 and attached thereto by another pair of axially spaced screws 214 received in apertures 216 respectively in the separate tubular portion 206 and screwed into the shank portion 204 or by other suitable means.

Figure 11:
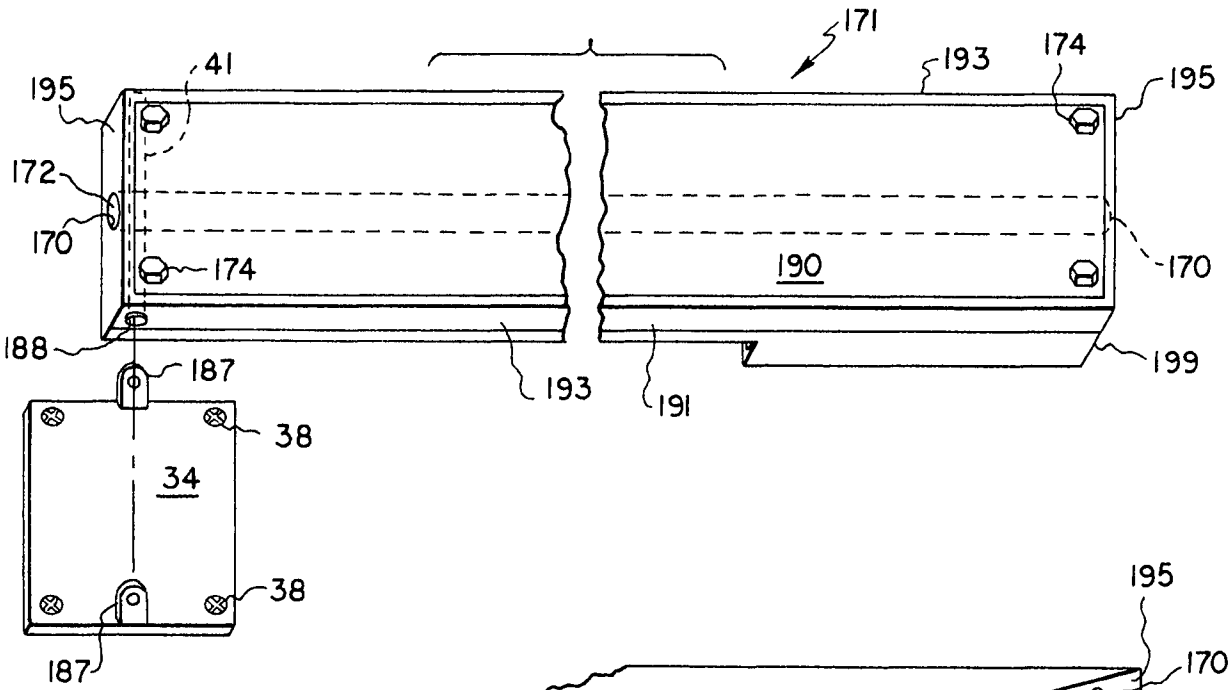
FIG. 11 is a perspective expanded view of a lateral adjustment mechanism which may be used with the present invention.
Figure 13:
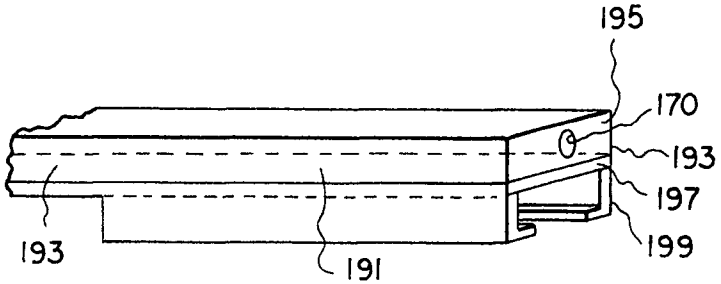
FIG. 13 is a perspective view of the other end portion of the adjustment mechanism.
Figure 12:
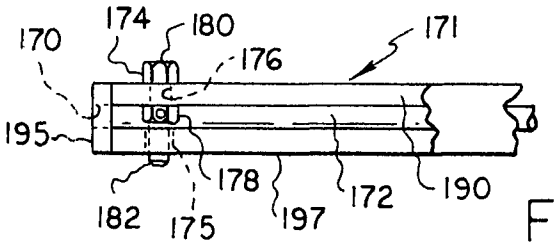
FIG. 12 is a side view, with a side wall of the housing removed, of an end portion of the adjustment mechanism.

Referring to FIGS. 11, 12, and 13, there is shown generally at 171 a lateral adjustment assembly for plate 190, which plate serves the same function (attachment of bindings) as plate 28 in FIG. 1. The lateral adjustment assembly 171 includes a housing 191 having side walls 193 joined by end walls 195 and a floor 197, the plate 190 being received over and spaced from the floor 197 and within the boundaries of the walls 193 and 195. For increased structural integrity, the floor 197 extends entirely over the length of the assembly 171, but it is not required that it do so. For example, floor portions may be provided at each end of the assembly 171 for purposes which will become apparent. An elongate rod 172 extends length-wise of the assembly 171 centrally of the width thereof, and the plate 190 rests thereon. The rod 172 is suitably fixedly received in and non-rotatably attached in a pair of apertures, illustrated at 170, in the end walls 195 respectively to allow the plate 190 to tilt laterally about the rod 172. Alternatively, the rod 172 may be mounted so as to be rotatable within the apertures 170, and the plate 190 may be attached fixedly to the rotatable rod. The lateral adjustment assembly 171 is provided to allow the plate 190 to be adjusted, for example, plus or minus about 3 degrees laterally to adjust the position laterally of the skier on the ski. A bolt or screw 174 is received in an unthreaded aperture 176 in each corner of the plate 190, and a nut 178 is screwed onto the bolt 174 so that the plate 190 is sandwiched between the bolt head 180 and the nut 178, and a roll pin (similarly as shown for roll pin 136 in FIG. 8) is inserted through the nut 178 and bolt shank 182 whereby the bolt 174 is prevented from vertical movement but can be turned to provide lateral adjustment. The bolt 174 is threadedly received in a threaded aperture, illustrated at 175, in the floor 197, whereby, by manipulation of the bolts 174 (i.e., by screwing inwardly on the bolts on one side of the plate 190 and by screwing outwardly a corresponding amount the bolts on the other side thereof), the lateral orientation of the plate 190 may be adjusted. The housing 191 is formed to have a track 199, similar to tracks 62 and 100, depending downwardly from the rear end portion thereof for rear height adjustment, and apertures 188 for receiving the pivot pin 41 (with the eyelet members 187 of plate 34 being disposed outwardly of the side walls 193 respectively) for pivotal movement of the assembly 171 at the forward end thereof.

Figure 15:
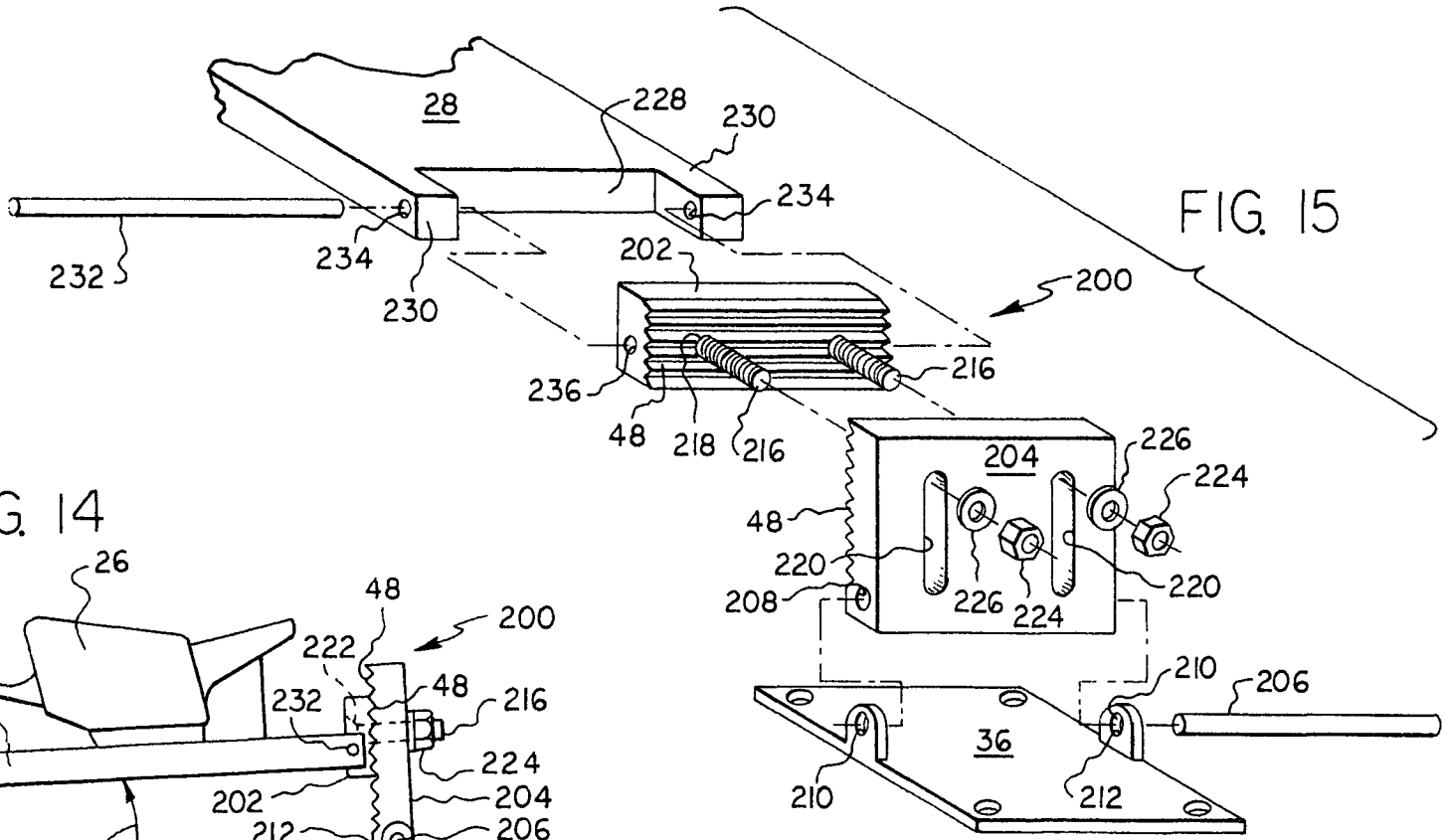
FIG. 15 is an exploded view of the height adjustment mechanism for the binding of FIG. 14.
Figure 14:
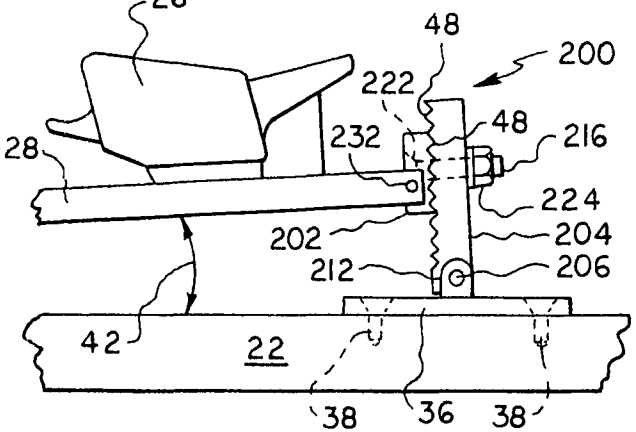
FIG. 14 is a partial view similar to that of FIG. 1 of a ski binding in accordance with another alternative embodiment of the present invention.

Referring to FIGS. 14 and 15, there is shown generally at 200 a height adjustment mechanism in accordance with an alternative embodiment of the present invention, the toe end portion having a hinged connection similar to that shown at 40 in FIG. 1. Height adjustment is provided by a pair of members 202 and 204 having the complementary teeth or serrations 48, similarly as shown for the assembly 43 of FIG. 1, on facing sides for interlockingly engaging each other. The member 202 is pivotally attached to the boot plate 28 as hereinafter described. The member 204 is pivotally attached to ski plate 36 by a hinged connection 50 similarly as shown for FIG. 1, including a hinge pin 206 which is received in an aperture, illustrated at 208, extending through a lower portion of the member 204 and through apertures, illustrated at 210, in eyelet members 212 protruding from opposite sides of the plate 36. Similarly as shown in FIG. 2, the members 202 and 204 are adjustably connected by a pair of screws 216 receivable in laterally spaced countersunk apertures, illustrated at 218, in member 202 and in laterally spaced vertically elongate apertures, illustrated at 220, in member 204, the head of one of the screws 216 illustrated at 222, and nuts and washers therefor illustrated at 224 and 226 respectively. Thus, the member 204 may be moved upwardly or downwardly relative to member 202 then fixed at an adjusted position by the interlocking serrations 48 engaging and by tightening of the nuts 224 on the screws 216 with the serrations interlocking with each other.

In accordance with a preferred embodiment of the present invention, in order to be able to adjust the angle 42 to a very small angle approaching zero degrees, the member 202 is pivotally attached to the rear end of the plate 28. Thus, the rear end of the plate 28 has a cut out, illustrated at 228, therein providing a pair of laterally spaced rearwardly extending protrusions 230. The member 202 is received in the cut out 228, and a pivot rod 232 is received in apertures, illustrated at 234, in the protrusions 230 and in an aperture, illustrated at 236, in the member 202. It should of course be understood that variations may be made in the assembly 200 as well as the other assemblies discussed herein. For example, instead of a single pin 232 or a single pin 206, a pair of short pins may be provided, each received on one side or the other of the respective member 202 and 204.

Figure 26:
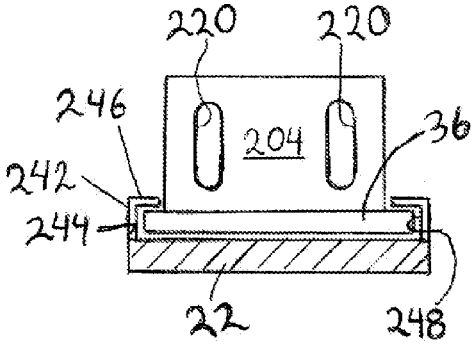
FIG. 26 is a partial sectional view of the ski binding of FIGS. 14 and 15 illustrating an alternative attachment to the ski.
Figure 25:
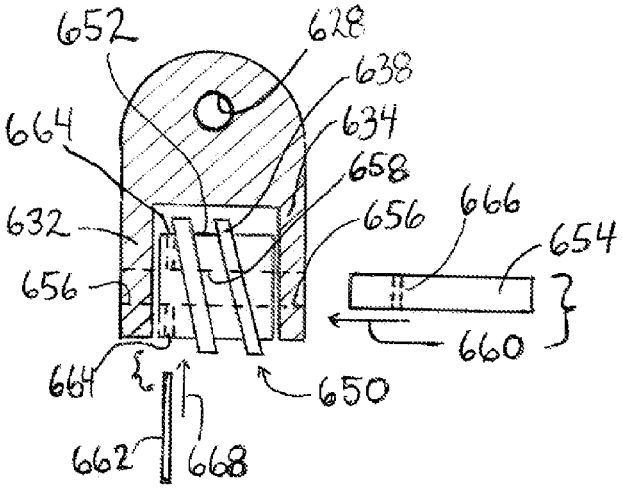
FIG. 25 is a view similar to that of FIG. 23 of an alternative embodiment thereof.

Referring to FIG. 26, there is illustrated a ski 22 having a built-in track 240 extending over a portion of its length, it being understood that the track 240 could alternatively be a separate piece or pieces attached to the ski 22 and may be otherwise suitably shaped. The track 240 comprises a pair of laterally spaced portions 242 each having a vertical portion 244 and a portion 246 extending inwardly from the upper end of the vertical portion 244, thereby defining slots 248 in which the plate 36 is slidably received to allow suitable flexing of the ski 22 during skiing. As seen wherein an end of the track is shown, the track 240 is open-ended to allow the plate 36 to be inserted into the track 240 and is desirably long enough so that the plate 36 does not come out of the track 240 during skiing. In this embodiment the plate 36 is not pivotally connected to serrated member 204 but may be otherwise suitably attached thereto. It should be understood that the serrated plate 204 is otherwise attached to the plate 28 similarly as shown and discussed hereinbefore with respect to FIGS. 14 and 15. It should also be understood that it is within the scope of the present invention that other embodiments in this specification may also utilize tracks on the skis 22 instead of on or in connection with the heel binding in order to allow suitable flexing of the ski 22 during skiing.

Figure 16:
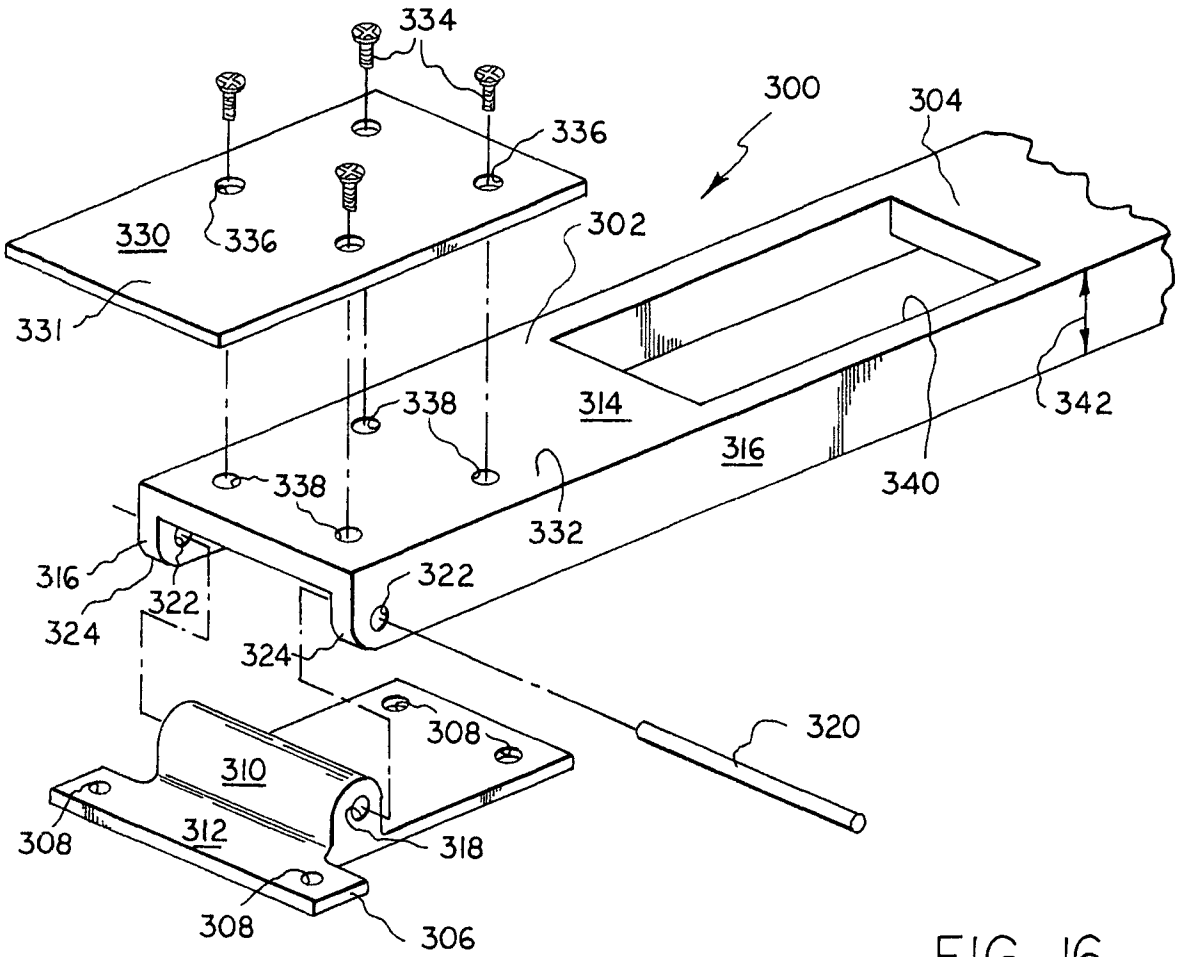
FIG. 16 is an exploded view of a binding attachment plate (partially shown) in accordance with another embodiment of the present invention, in combination with a toe end pivot structure.

Referring to FIG. 16, there is shown generally at 300 a plate to which toe and heel bindings 24 and 26 (not shown in FIG. 16) are attached and which is height adjustably attachable to a ski 22 as discussed hereinbefore. The plate 300 has a toe end portion 302 and a heel end portion 304 which are similar to the toe and heel end portions 30 and 32 respectively of FIG. 1. The plate 300 includes a generally flat portion 314 upon which the bindings are attached and a pair of flange portions 316 extending downwardly from the lateral edges of the flat portion 314. The toe end portion 302 is pivotally attached to a plate 306 which is in turn attached to the ski 22 by screws such as screws 38 in FIG. 1 received in apertures, illustrated at 308, in the plate 306 and threadedly received in apertures in the ski 22. The plate 306 is formed to have an upstanding tubular hinge portion 310, i.e., having a bore, illustrated at 318, extending laterally of the plates 300 and 306 therethrough. Forward of the hinge portion 310 is an increased width portion 312 of the plate 306, i.e., a portion which generally extends to the lateral edges of the ski 22. While shown to be integrally formed with the plate 306, it should be understood that the hinge portion 310 may be a separate member which is welded or otherwise suitably secured to the plate 306. In order to pivotally attach the forward end of the bindings or boot plate 300 to the ski plate 306, a hinge pin 320 is received in the bore 318 and in apertures, illustrated at 322 in the forward ends of the flange portions 316. The flange portions 316 have rounded lower forward end corners, illustrated at 324, in order to provide clearance with plate portion 312 during pivoting movement thereof. The plate 306 is of reduced width relative to the portion 312 thereof so as to be able to fit between the flange portions 316.

Race plates have been provided to raise the boots and bindings above the skis for greater leverage. In order to accommodate almost any size boot, these race plates are often made long, for example, 24 inches. Thus, if plate 300 were 24 inches long, it would accommodate the boots of all or almost all skiers. However, since the plate 300 must be of sufficient thickness to suitably accommodate forces acting thereon, such a length undesirably increases the weight thus undesirably increasing the burden of carrying the skis, especially for smaller people who have boot sizes which do not require such long plates. In order to reduce the carrying burden on smaller (as well as larger) persons while also accommodating larger boot sizes of larger persons, in accordance with the present invention, the bindings plate 300 is made to a relatively smaller length of, for example, 18 inches, and a decreased thickness extension 330 is attached to the top surface of flat plate portion 314 at the forward end portion 332 thereof to increase the length thereof by, for example, about 2 inches, to 20 inches overall. If desired, the extension may be provided to increase the length thereof by, for example, about 4 inches or longer, to 22 or more inches overall. The extension 330 is attached to the plate 300 by screws 334, for example, 4 no. 10-32 flat head screws, received in counterbored (to accommodate the flat heads) apertures, illustrated at 336, in the rearward end portion of the extension 330 and threadedly received in threaded apertures, illustrated at 338, in the forward end portion 332 of the flat plate portion 314. The forward end portion 331 of the lighter (less thickness) extension thus extends forwardly beyond the plate 300 to increase the overall plate length by as much as 2 or more inches.

Snow may tend to build up and cake between the plate 300 and the ski 22. This is a type of problem which used to be encountered under boots with the solution in recent years being that the soles of boots have been conventionally contoured to allow the escape of the snow. In order to allow snow to escape from between the plate 300 and the ski 22 as well as to reduce the carrying burden even more for both small and large people, a lightening cutout, illustrated at 340, is provided centrally of the length of the plate 300 (between the attachments of the bindings). While the cutout 340 is shown to be rectangular in shape, it should be understood that it may otherwise be suitably shaped or provided in other ways such as a series of apertures.

The following dimensions of the plate 300 and extension 330 as well as other dimensions and examples contained herein (unless the context clearly indicates otherwise) are for exemplary purposes only and not for purposes of limitation. The overall length and width of plate portion 314 may, for example, be about 18 inches and about 2¼ inches respectively. The flange portion height, illustrated at 342, may, for example, be about ½ inch. The thickness of each of the plate and flange portions 314 and 316 respectively may, for example, be about ¼ inch. The extension 330 may have a length, width, and thickness of about 4 inches, about 2¼ inches, and about 3/16 inch respectively and is attached to the plate 300 so as to extend, for example, about 2 inches forwardly thereof. The cutout 340 begins, for example, about 4½ inches from the forward edge of the plate 300, extends lengthwise of the plate 300 a distance of, for example, about 4 inches, and extends widthwise, for example, over the entire distance between the flange portions 316. The plates 300, 306, and 330 are made of aluminum or other suitable material.

It should be understood that, while tracks such as at 62 in FIG. 2 or 74 in FIG. 4 are shown on the boot plate (and of course may alternately be directly on the boot), they may alternatively be on the ski plate or directly on the ski.

It should be understood that, as used herein and in the claims, the term "serrations" is intended to include various teeth or saw-like notches or other suitable segments on one member which are formed to interlock with teeth or saw-like notches or other suitable segments on another member. For example, the serrations may have a staircase-like shape.

Figure 17:
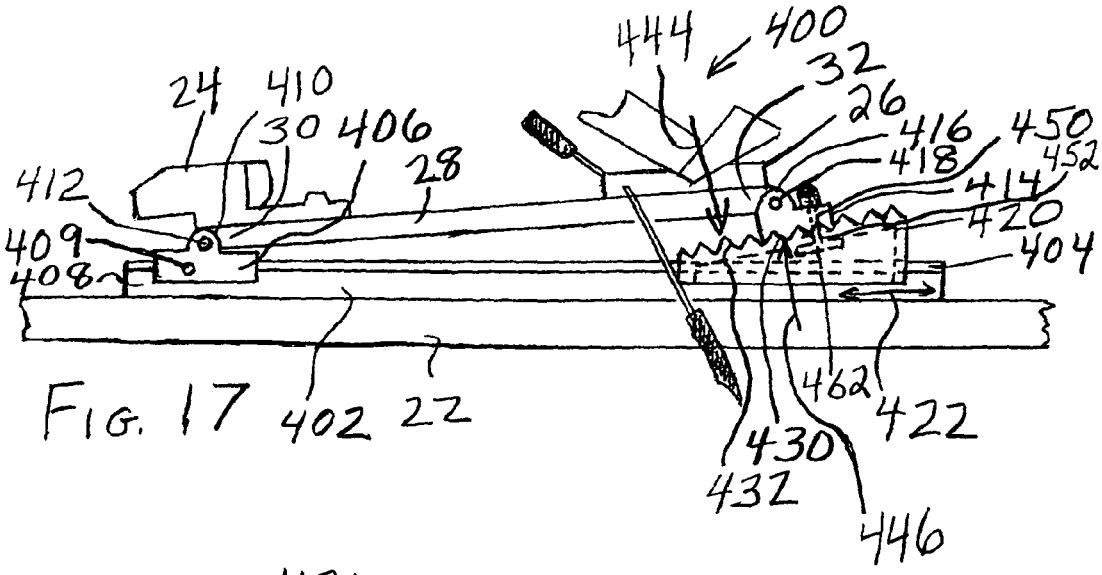
FIG. 17 is a view similar to that of FIG. 1 of a ski binding in accordance with another alternative embodiment of the present invention.
Figure 18:
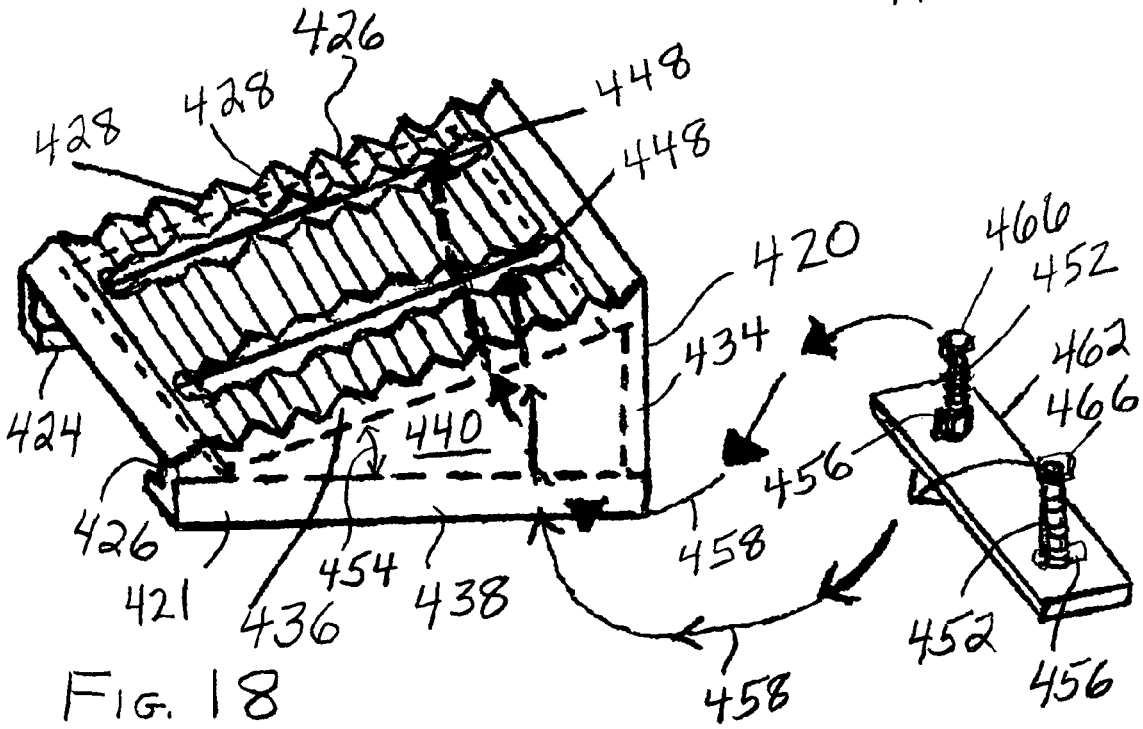
FIG. 18 is an enlarged detail perspective exploded view of the ski binding of FIG. 17 illustrating attachment of a heel adjustment block thereof to the ski.
Figure 19:
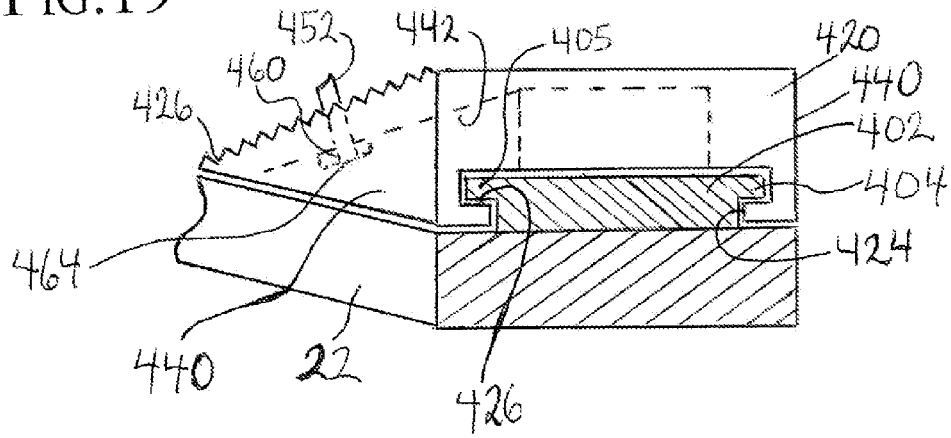
FIG. 19 is an enlarged detail perspective view of the block of FIG. 18 received on a rail attachable to a ski.

Referring to FIGS. 17 to 19, there is illustrated generally at 400 another alternative embodiment of the ski binding of the present invention. In order to allow the heel portion to slide relative to the ski 22 to enable sufficient and even ski flexion similarly as discussed with respect to the embodiment of FIGS. 1 to 4, an elongate track member 402 is suitably mounted on, such as by bolts or screws (not shown), or may alternatively be integral with or built into, the upper surface of the ski 22. The track 402 has an increased width upper portion or lip 404 defining a pair of elongate lateral protrusions or rails 405 extending generally over the length of the track member 402 (but need only extend enough over the track member length as needed for its purpose as described hereinafter). For example, the track 402 and ski 22 may be provided/sold pre-assembled (or integral) from a factory with the track 402 in a standard shape for receiving similarly standard-shaped toe and heel piece bindings 24 and 26 respectively to allow adjustment thereof longitudinally along the length of the ski 22, as is commonly known in the art. The track 402 is typically composed of molded plastic but may be composed of metal or other suitable material.

A suitable member 406, which may be composed of molded plastic or metal or other suitable material, is fixedly attached or locked in place, such as by one or more screws, bolts, pins, or other suitable fasteners or locking devices, illustrated at 409, to the toe end portion 408 of the track 402, but alternatively the member 406 may be formed integral with the track 402. The lower portion of the member 406 is suitably shaped so that it can be slid onto and along the track 402. The member 406 has a pair of laterally spaced upper ears 410 (one shown) between which the toe end portion 30 of the plate 28 (for receiving the bindings) is received and pivotally attached by a pin 412 suitably received in apertures in the end portion 30 (adjacent the end of the plate 28) and ears 410.

A block 414, which may be composed of molded plastic or metal or other suitable material, has a pair of laterally spaced upper forward ears 416 (one shown). The heel end portion 32 of the plate 28 is received between the ears 416 and pivotally attached to the block 414 by suitable means such as a pin 418 suitably received in apertures in the end portion 32 (adjacent the end of the plate 28) and ears 416.

A block 420, which may be composed of molded plastic, metal, or other suitable material, is formed to have a lower portion 421 suitably shaped to slide onto the rear end of and engage rail 402 for sliding of the block 420 longitudinally of the ski 22 along the rail 402, as illustrated at 422. Thus, the lower surface of the block 420 has a longitudinal recess, illustrated at 424 in FIG. 19, the inner portion 426 of which is widened to slidably receive the lateral rails 405. The block 420 has a surface 426 which has a series of serrations 428 which interlockingly engage complementary serrations 430 on a lower surface 432 of the member 414 for height adjustably attaching the heel binding 26 to the ski 22 as described in greater detail hereinafter.

Two vertically oriented members with interlocking serrations connecting a heel binding with a ski, such as shown in FIGS. 10 and 11 of the aforesaid U.S. Pat. No. 4,135,736, may be considered to not provide as much stability as may be desired. In order to distribute the pressure better on the serrated surfaces so as to provide improved stability, the block 420 is suitably formed so that the serrated surface 426 thereof is inclined. Thus, for example, as illustrated, it has a vertical rear wall 434, an inclined wall 436 extending from the upper edge of the rear wall 434 downwardly and forwardly to the forward edge of the bottom wall 438 in which the recess 424 is contained, and a pair of generally triangular side walls 440, leaving a generally hollow space, illustrated at 442, which will be discussed in greater detail hereinafter. As a result of the inclined surface 426, it can be seen in FIG. 17 that forces are applied in a direction generally perpendicular or normal to the inclined wall 436 of the block 420, as illustrated at 444, as well as generally perpendicular or normal to the block 414, as illustrated at 446, which can better withstand the applied forces from the boot (i.e., forces applied when one is standing normally in the boot on the ski and during normal skiing) than if the forces were applied in a direction generally parallel to the serrated surfaces to hereby achieve a more stable interlocking attachment. By "generally perpendicular" or "generally normal" of an applied force relative to a block surface or wall, as used herein and in the claims, is meant that the force vector or component of the applied force in a direction normal or perpendicular to the surface or wall is greater than the force vector or component of the applied force in a direction parallel to the surface or wall. Preferably, the applied forces from the boot are substantially normal or perpendicular (i.e., within about 10 degrees of being normal or perpendicular) to the block surface or wall. Preferably, the surface 426 or wall 436 is inclined at an angle, illustrated at 454, between about 1 and 50 degrees, for example, about 15 degrees. It may be as low as 1 degree because racers may already be well adjusted but may wish to fine tune their balance. The inclined surface 426 allows the height of the heel binding 26 to be adjusted by adjusting the position of the inclined block 420 relative to the block 414 by adjustable movement thereof longitudinally, as illustrated at 422, along the length of the track 402. As seen in FIG. 17, movement of the inclined block 420 forwardly (toward the toe end 408) causes a higher portion of the block 420 to engage the block 414 so that the height of the heel binding 26 is adjusted higher.

In order to lock the inclined block 420 at a desired heel binding height, the inclined wall 436 has a pair of longitudinally extending spaced parallel grooves, illustrated at 448, therein extending therethrough substantially over the length thereof. The block 414 has a pair of similarly spaced apertures, illustrated at 450, extending therethrough. Bolts 452 or other suitable fasteners are received in grooves 448 and apertures 450 respectively, as illustrated at 458, and nuts 456 applied and tightened to fix or lock the serrations 428 and 430 together to lock the inclined block 420 in the position for the desired heel binding height, illustrated at 458. The hollow space 442 is provided to allow the bolts 452 to be placed in position. Preferably, the bolts 452 (or studs) are threadedly received tightly in threaded spaced (equal to the spacing between grooves 448) apertures, illustrated at 460, in a suitable plate 462 and their heads 464 (or stud ends) may be welded to the plate 462. In order to adjust the position of the inclined block 420 for height adjustment, the nuts 456 are suitably loosened and the inclined block 420 moved along the track 402 to the desired new position, then the nuts 456 tightened at the new position. It is unnecessary that the nuts 456 be removed from the bolts 452 during such adjustment. However, a stop member 466 may be applied to the end of each bolt 452 to prevent the respective nut 456 from becoming inadvertently removed. The stop member 466 may, for example, be a nut or washer or a pin welded or otherwise suitably fixed thereto. It should of course be understood that the locking of the serrated surfaces in a desired position may be achieved by other suitable means such as, for example, by the use of a single slot 448 and/or by the use of another suitable fastening mechanism such as, for example, a cam locking device used with the slot or slots 448. For another example, the plate 462 may be dispensed with and the pair of bolts 452 may have heads large enough so as not to pass through the slots 448. For another example, the inclined block 420 may be formed not to have the hollow space but instead have a slot underneath the inclined wall 436 which allows movement of the plate 462 along the length of the inclined wall 436 (which might require the inclined block 420 to be composed of two pieces which are then welded or otherwise suitably attached together and the plate 462 and bolts 452 placed in position before such attachment). For another example, the inclined block 420 may be formed to have two or more narrow slots underneath the inclined wall 436 which allow movement of the heads of bolts (without a plate) along the length of the inclined wall 436.

As previously discussed, the pre-assembled rail and ski may come in different configurations. For example, referring to FIG. 20, there is illustrated generally at 500 a combination of a ski 502 with an inclined block 420, with a track 504 formed or built into the ski 502. Thus, the track 504 is formed by a longitudinal recess, illustrated at 506, in the ski 502, the inner or lower part 508 of the recess 506 being widened to provide a track. In order to conform the inclined block 420 to be complementarily received in the track 508, the lower part of the inclined block 420 is suitably formed to have a narrowed neck portion 510 terminating there below in a widened head portion 512 which is slidable received in the track 508. It should of course be understood that a pre-assembled ski/track or other track or ski with built-in track may have various track shapes, and the inclined block 420 is suitably constructed to accommodate whatever the shape of the track.

Figure 20:
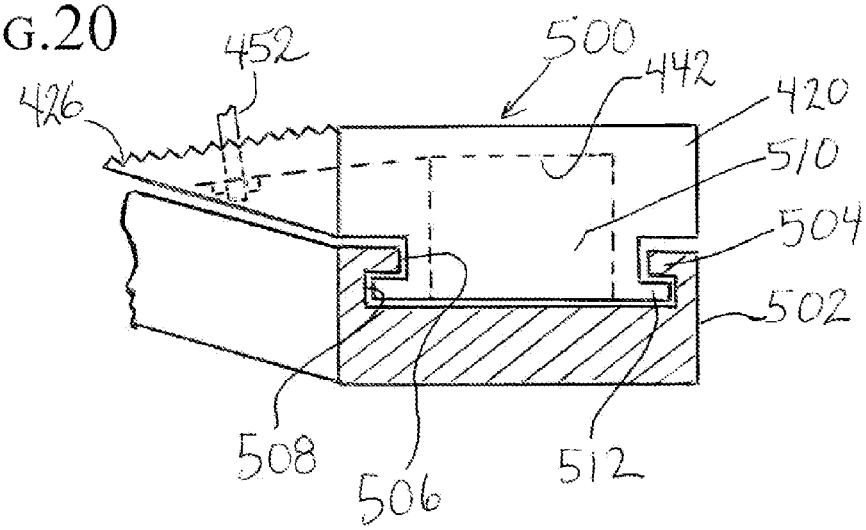
FIG. 20 is a view similar to that of FIG. 19 of an alternative embodiment of the ski binding of FIG. 17 wherein another embodiment of the block and rail is illustrated.

It should be understood that an inclined block may be moved along a track for height adjustment and held in an adjusted position by other means than interlocking serrations. Referring to FIGS. 21 to 24, there is illustrated generally at 600 structure attached to ski 22 and to the rear end of plate 28 (as an alternative to the blocks 414 and 420 in FIGS. 17 to 19). The structure 600 includes an inclined block 602 having a lower portion formed to slidably receive track 402, similarly as in FIG. 19, and it should be understood that the track may be otherwise suitably shaped such as shown in FIG. 20 and the block 602 suitably shaped to be complementary thereto for sliding along the track.

The inclined block 602, which may be composed of molded plastic, metal, or other suitable material, has a longitudinal (along the length of the ski 22) recess, illustrated at 604, in its upper surface, the recess 604 having an inner laterally increased width portion, illustrated at 606, which defines laterally spaced tracks 608 having inclined upper surfaces 610 on the laterally opposite sides. The inclined surfaces 610 extend downwardly from the rear or heel end toward the front or toe end. The bottom surface 612 of the recess 604 has a plurality of longitudinally spaced indents or notches or recesses, illustrated at 614, suitably formed therein generally laterally centrally thereof.

A block 616 has a generally cylindrical laterally extending portion 618 which is received in a cutout, illustrated at 620, between a pair of lateral end portions 622 of the plate 28 (the end portions 622 defined by the cutout 620). A pin 624 is suitably received in each of the apertures, illustrated at 626 (one shown), in the end portions 622 and in an aperture, illustrated at 628, extending axially through the entire width of the generally cylindrical portion 618, thereby pivotally connecting the block 616 to the ski binding plate 28.

Figure 21:
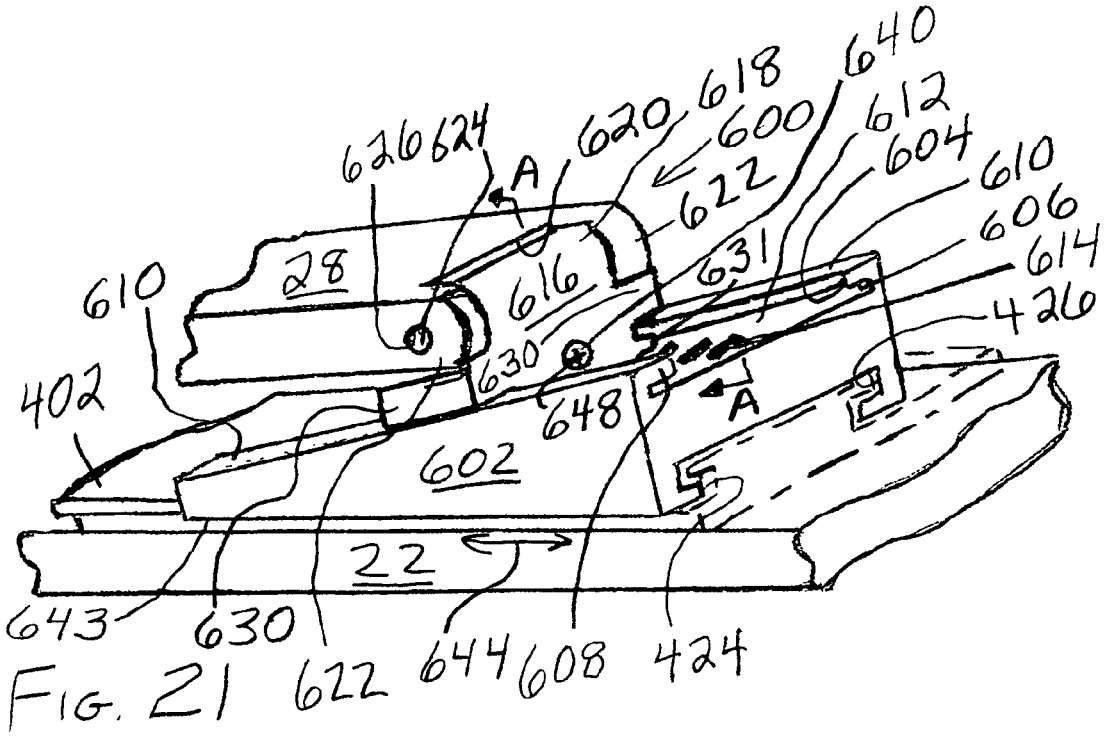
FIG. 21 is a partial view illustrating height adjustable attachment of binding to a ski in accordance with another embodiment.
Figure 22:
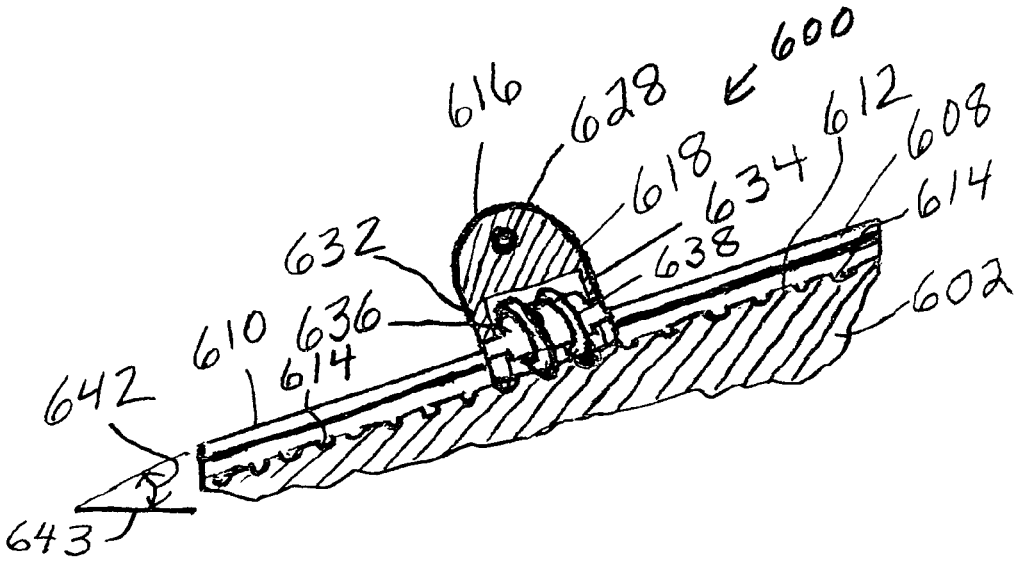
FIG. 22 is a partly sectional view, with portions removed for purposes of clarity, taken along lines A-A of FIG. 21.
Figure 23:
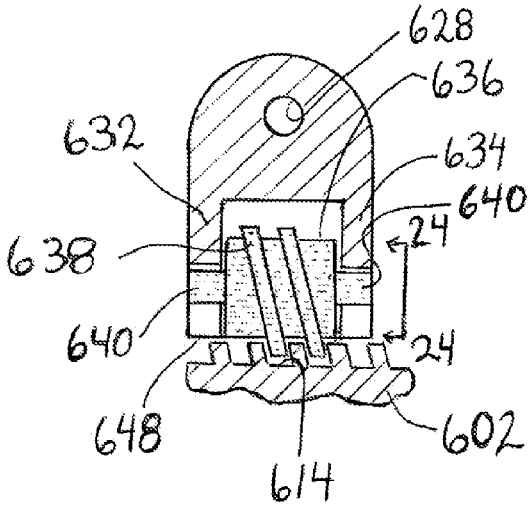
FIG. 23 is an enlarged detail view, partly sectional, of the upper block of the embodiment of FIG. 21, similarly as shown in FIG. 22.
Figure 24:
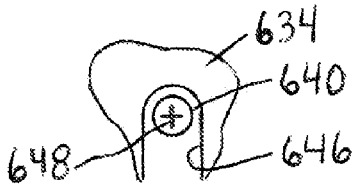
FIG. 24 is a partial view taken along lines 24-24 of FIG. 23.

The block 616, which may be composed of molded plastic, metal, or other suitable material, is formed to have a pair of upper portions 630 which are laterally projecting so as to be positioned to ride on the inclined surfaces 610 respectively and a pair of lower portions 631 (one shown) which are also laterally projecting so as to be positioned to fit within the increased width portion 606 and underneath the tracks 608 respectively so that the block 616 is lockingly but slidingly received on the tracks 608. The block 616 is further formed to have front and rear laterally centrally disposed walls 632 and 634 respectively (FIGS. 22 and 23) extending downwardly from the generally cylindrical portion 618 and between which is suitably centrally mounted to turn in place a screw 636 having enlarged threads 638. For example, FIGS. 22 and 23 show the thread 638 (i.e., two thread portions whose spacing is the same as the spacing of the notches 614) engaging two of the notches 614. The screw 636 terminates at its ends in a pair respectively of reduced diameter axle portions 640 which are rotatably received in vertical slots, illustrated at 646, in the walls 632 and 634 respectively, the slots 646 being recessed into the bottom surfaces 648 thereof, as best seen in FIG. 24. The axle portions 640 are held in place (i.e., without falling downwardly in or out of the slots 646) when the blocks 602 and 616 are assembled with the relative position of the block 616 fixed since it engages the tracks 608. The blocks 602 and 616 are assembled by holding the screw 636 in the slots 646 and, engaging the block 616 on the tracks 608 from the end thereof while at the same time effecting engagement of the screw thread 638 with the first of the indents 614 and continuing to turn the screw 636 to advance the block 616 further onto the tracks 608. As the screw 636 is turned (such as by a screwdriver received in slot 648 in the end surface of an axle portion 640), the thread 638 continues to successively engage notches 614 thus effecting movement of the inclined block 602 longitudinally. Preferably, the surface 610 is inclined at an angle, illustrated at 642 (which is the same as previously discussed for the angle 454), relative to the lower surface 643 of the block 602. The inclined surface 610 allows the height of the heel binding 26 to be adjusted by adjusting the position of the inclined block 602 relative to the block 616 by adjustable movement thereof longitudinally, as illustrated at 644, along the length of the tracks 608. As seen in FIG. 21, movement of the inclined block 602 forwardly (toward the toe end 408) causes a higher portion of the block 602 to engage the block 616 so that the height of the heel binding 26 is adjusted higher.

The screw 636 may be otherwise suitably embodied. For example, referring to FIG. 25, there is shown a screw 650 comprising a rotatable cylindrical body 652 which has thread 638. The body 652 is disposed between and connected to the walls 632 and 634 by a cylindrical axle 654 which is rotatably received in apertures, illustrated at 656, in the walls 632 and 634 and in a bore, illustrated at 658, which extends axially through the screw 650, as illustrated at 660. The axle 654 is fixedly connected to the screw 636 by a pin 662 which is suitably received in aligned radially extending apertures, illustrated at 664, in the screw body 652 and in a radially extending aperture, illustrated at 666, in the axle 654, as illustrated at 668, or otherwise suitably connected.

It should be understood that it is within the scope of the present invention that other suitable means may be provided for advancing block 616 or other suitable block along the inclined surface of block 602 or other suitable block. For example, the indents 614 may instead be raised bumps or projections, with the screw thread engaging between the bumps for advancing the block 616 along the inclined surface of block 602.

It should be understood that it is within the scope of the present invention that either of the blocks 414 or 616 be attached directly to heel binding rather than the plate 28. Thus, a recitation herein or in the claims that a member engages or is attached to a boot or a heel or toe portion thereof or to a ski is intended to mean that it is engaged or attached directly thereto or to a plate or track or other member which is attached thereto. Likewise, a recitation that a member engages such a plate or track or other member is intended to include that it is engaged or attached to the boot or a heel or toe portion thereof or to the ski.

Figure 27:
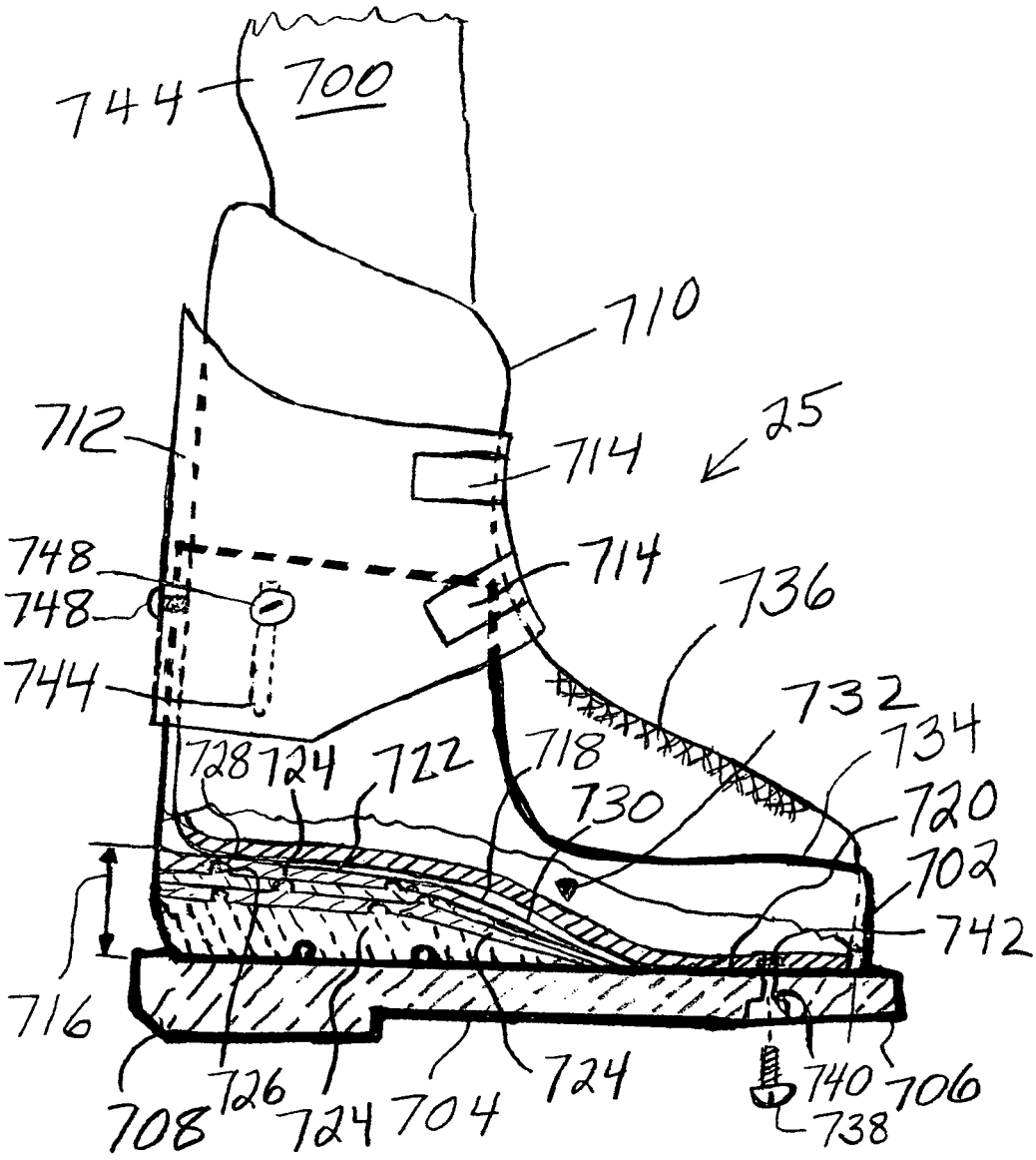
FIG. 27 is a side view, partly in section and partly schematic, of the boot.
Figure 28:
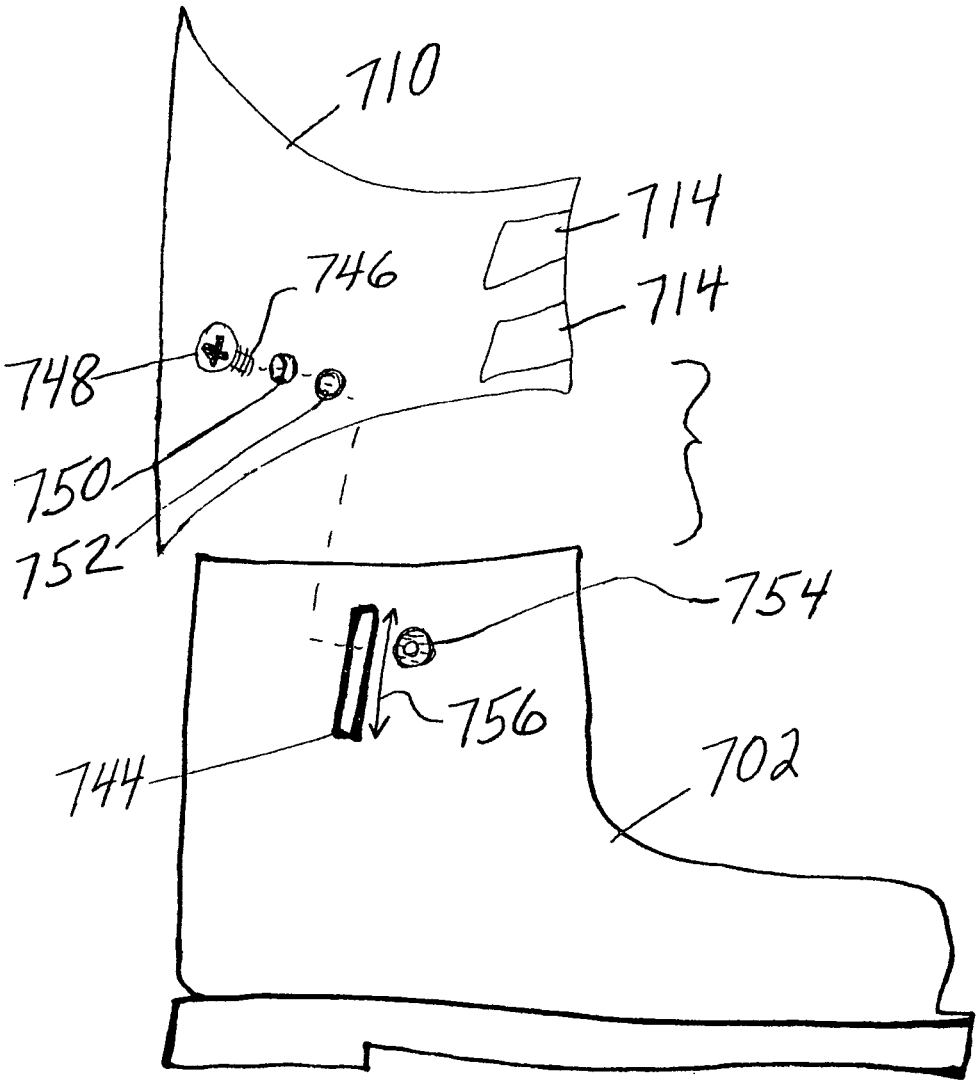
FIG. 28 is a partial exploded view of the boot, illustrating attachment of the cuff to the shell of the boot.

Referring to FIGS. 27 and 28, the boot 25 includes a lower shell 702 which is made of rigid plastic or other suitably rigid material and which encases the skier's foot, illustrated at 700, for transferring movement from the skier to the shell 702 then to the ski 22. The shell 702 has a sole portion 704 the toe and heel end portions 706 and 708 respectively of which are suitably and conventionally received in bindings 24 and 26 respectively. As is typical, the skier's foot and lower leg portion 700 are snugly received in a liner 710 composed of a suitably soft waterproof material providing warmth, and the liner 710 is snugly received in the shell 702. An upper rigid cuff or upper shell 712, made of similar material as shell 702 is made, wraps around upper portions of the shell 702 and liner 710, and upper and lower buckles 714 or other suitable means attach front edges of the cuff 712 to secure the parts of the boot 25 tightly together to tightly encase the foot and lower leg portion 710.

Good balance as well as mobility and flexion while skiing not only depends on the adjustment of the boot heel portion height, as discussed above, but also on the contour of the footboard to match the optimum positioning of the bottom of the foot itself as it fits within the boot 25. Moreover, good balance as well as mobility and flexion in any footwear also depends on the contour of the footboard to match the optimum positioning of the bottom of the foot itself as it fits within the footwear, including the heel to forefoot height differential, illustrated at 716. As used herein and in the claims, the heel to forefoot height differential is the difference in height of the footboard or bootboard, illustrated at 718, between where the forefoot rests, illustrated at 720, and where the heel rests, illustrated at 722, the footboard or bootboard 718 being the upper surface of the sole (or built-up sole as described hereinafter with respect to FIG. 27) upon which a foot (or insole or liner such as liner 710 rests) within the boot 25 or other footwear. However, the desired footboard contour may be provided by varying the thickness of the lower portion or bottom of the liner 710, whereby the liner 710 may be said to contribute to the built-up sole, as described hereinafter, or by other suitable means. When the liner lower portion is thusly built-up, the footboard is alternately defined as the contour of the surface of the bottom or lower portion of the liner on which the foot rests.

Conventional ski boots which are not adjusted for this differential 716 and other footboard contour may leave the numerous bones in the foot in a jammed or misaligned condition, which makes balancing and athletic movement difficult for many skiers, especially women. In order to provide better balance and athletic movement for a skier, the desired or optimum differential 716 as well as other footboard contour, after it is determined as discussed hereinafter based on what is optimum for the individual as perceived by the individual, is shown to be achieved by positioning one or more inserts 724 of plastic or other suitable material and of the same or varying thicknesses between the liner 710 and the sole 704, thereby providing a "built-up sole." These inserts 724 are shown to be held in place by, for example, one or more protruding portions 726 on one insert 724 which are interlockingly received in indents 728 in an adjacent insert 724, it being understood that they may be held in place by other suitable means such as screws. For example, the lower insert 724 may have a thickness (at the heel end) of about ½ inch, and the upper inserts 724 may have a thickness (at the heel end) of about ⅛ inch, and all the inserts 724 suitably taper towards the toe portion to provide the arch, illustrated at 730, to suitably provide for the resting of the arch of the foot thereon. Thus, the heel to forefoot height differential 716 in the boot 25 may, for example, be about ⅞ inch.

The liner 710 may be a single piece with a cushionary bottom or it may have a cushionary member (insole) in the bottom which receives the foot. If the inserts 724 are suitably sized and shaped to provide the optimum foot position, as discussed hereinafter, then it is unnecessary to alter the conformable liner, which, being flexible, should suitably conform thereto.

The determination of the contour of the footboard 718 will be discussed hereinafter with respect to various footwear, it being understood that the discussion thereof will apply to the boot 25.

As seen at 732, the insertion of the inserts 724 results in a narrowed passage for the foot. In order to accommodate for such a narrowing, the upper front of the shell 702 has a cut-out, illustrated at 734, which provides an opening over the foot instep to allow the liner 710 and the foot received therein to protrude through the cut-out. To secure the forefoot, the liner 710 is provided with laces, illustrated at 736, or with other suitable means such as, for example, Velcro material or straps.

Unlike in a typical ski boot, the cut-out 734 does not allow the liner 710 to be secured by the shell 702 extending over the forward portion thereof. In order to suitably secure the liner 710 so that, for example, the foot does not come out of the boot 25 if the skier leans back, the toe portion of the liner 710 is suitably affixed to the toe portion of the sole 704 such as, for example, by one or more screws 738 each received in an aperture, illustrated at 740, and threadedly received in a small rigid plate 742 suitably built into the liner 710 or by other suitable fasteners or interlocking arrangements such as, for example, bolts or pins.

The cuff is typically attached to the shell of a ski boot with cammed fasteners or knobs or studs, such as in the above discussed Vento ski boot, which are advertised to allow longitudinal flex of the boot to be adjusted and to allow the cuff to be adjusted from a neutral position to an inwards or outwards tilt. Except as discussed herein, the boot 25 may as applicable be similar to the Vento ski boot. Such flex and tilt adjustments may have the incidental consequence merely as a result of their functioning of effecting a small movement of the cuff 710 vertically relative to the shell 702 of typically less than about ¼ inch.

As the heel height is increased within the boot 25, the lower leg 700 may extend higher above the cuff 710 than is comfortable or suitable, and, especially for a woman, her calf muscle, illustrated at 744, may undesirably get moved forward. In order to provide for suitable placement of the cuff 710 as the heel height is increased within the boot 25, in accordance with the present invention, the cuff 710 is height adjustable relative to the shell 702. Such height adjustment may be provided, for example, by one or more circumferentially spaced vertical slots, illustrated at 744, in the shell 702 (for example, 3 such slots, one on either side of the boot and one in the back thereof). Referring to FIG. 28, for example, a screw 746 with a large head 748 passes through a suitably sized bushing 750 that is suitably fitted in a suitably sized hole, illustrated at 752, in the cuff 710 then through the slot 744 then secured with a suitable nut 754. Nut 754 may, for example, be a t-lock nut to grip the shell 702 around the slot 744 so that the cuff 710 is secure and unable to move up and down. Alternatively, vertical adjustment may be made, for example, by, instead of the slot 744, a series of vertically evenly spaced holes in each of the sides and back of the shell 702.

In order to provide adequate vertical adjustment to suitably accommodate the various heel height changes that may be made, in accordance with the present invention, the height adjustability of the cuff 710 relative to the shell 702 is at least about 1 inch (for example, about 2 inches) and accordingly the length, illustrated at 756, of the slot 744 is preferably at least about 1 inch (for example, about 2 inches). Preferably, the height adjustability of the cuff 710 relative to the shell 702 is at least equal to the maximum heel height change that may occur.

Figure 29:
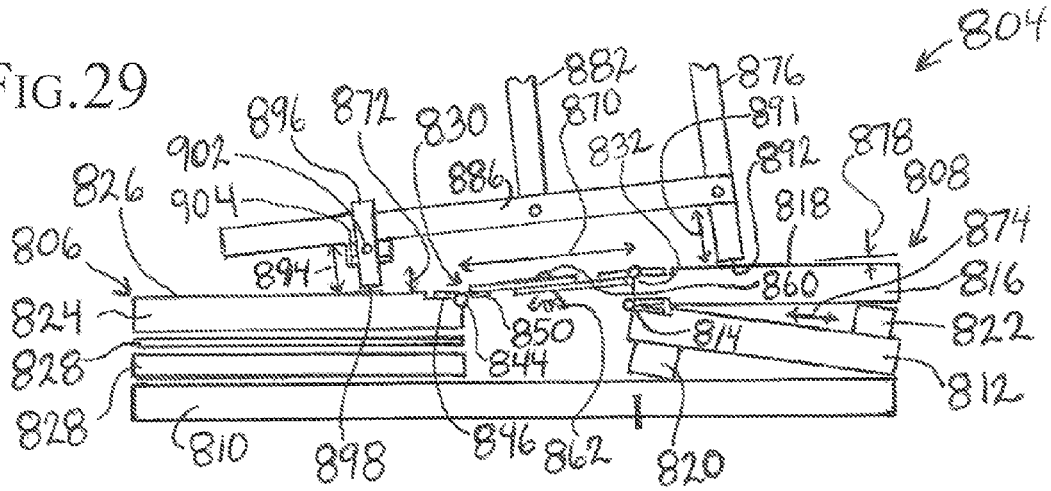
FIG. 29 is a side view of apparatus in accordance with the present invention for taking measurements relative to foot contour in an optimal position, illustrating the use of a measuring device (shown partially) therewith.
Figure 30:
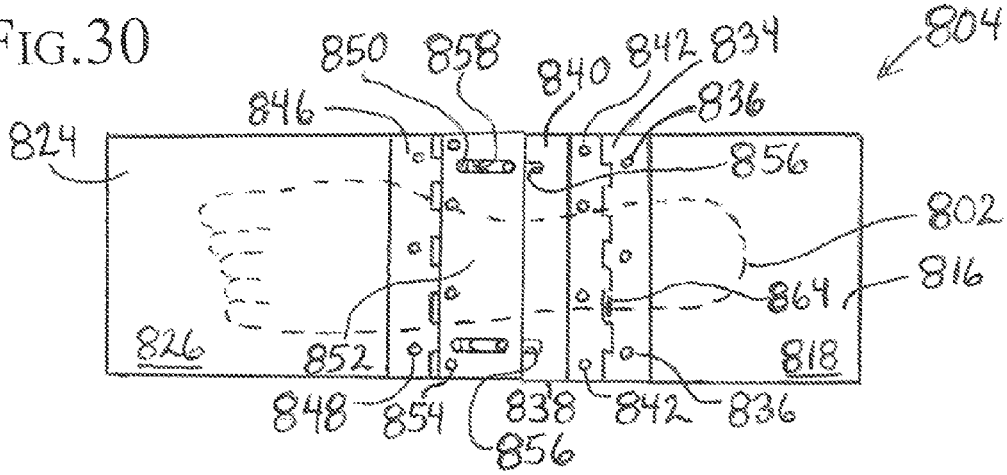
FIG. 30 is a plan view thereof and illustrating in phantom lines the placement of a foot thereon for measuring.

Referring to FIGS. 29 and 30, in order to build up the sole of ski boot 25 (FIG. 27) or of other footwear such as shoe 800 (FIG. 34) to an optimum contour/height, the contour of the bottom of the foot 802 is first measured/determined by use of a suitable apparatus such as the apparatus illustrated generally at 804. As used herein and in the claims, the terms "shoe" and "footwear" are intended to include boots, sandals, slippers, and any other form of footwear as well as shoes. Apparatus 804 includes a toe end assembly, illustrated generally at 806, and a heel end assembly, illustrated generally at 808, which rest on a generally horizontal surface such as provided by flat support member 810. The assemblies 806 and 808 may be made of wood or other suitable material, for example, flat members discussed hereinafter may be boards.

The heel end assembly 808 includes a lower flat member 812 hingedly connected as by hinge, illustrated at 814, at its upper inner corner to the lower inner corner of an upper flat member 816 providing an upper surface 818. An elongate member (square of rectangular in cross-section) 820 extends cross-wise of the assembly 808 and is suitably attached, as by gluing, to the lower surface of member 812 adjacent the inner end thereof, thus resulting in the member 812, with its outward end resting on the support member 810, being inclined upwardly as it extends inwardly to the hinge 814. A wedge member 822, which may be similarly shaped as member 820, is removably receivable between the flat members 812 and 816 for reasons which will be discussed hereinafter.

The toe end assembly 806 includes a flat member 824 providing an upper surface 826. A plurality of flat members 828, which may be of varying thickness but need not be so, are removably receivable between the flat member 824 and the support member 810 for reasons which will be discussed hereinafter.

An assembly, illustrated generally at 830, interconnects the upper inner ends of the flat members 816 and 824. The assembly 830, whose parts may be composed of a suitable metal, includes a hinge 832 one leaf 834 of which is suitably connected to flat member 816 as by spaced screws 836 and the other leaf 838 of which is connected to plate 840 as by rivets 842. The assembly 830 similarly includes a hinge 844 one leaf 846 of which is suitably connected to flat member 824 as by spaced screws 848 and the other leaf 850 of which is connected to plate 852 as by rivets 854. Plate 840 has a pair of laterally spaced elongate slots, illustrated at 856, which extend in a direction toward and away from the flat members 816 and 824. Plate 852 similarly has a pair of laterally spaced elongate slots, illustrated at 858, which also extend in a direction toward and away from the flat members 816 and 824. The plates 840 and 852 vertically overlap each other so that their respective slots 856 and 858 are alignable, and a screw 860 is receivable in each respective pair of aligned slots 856 and 858 and secured by a wing nut 862 to connect the plates 840 and 852.

In order to use the apparatus 804, a mark, illustrated at 864, is placed on the foot 802 at the forward end of the heel 866. The length, illustrated at 868, of the foot arch is measured, the foot arch being from mark 864 forward to the fifth metatarsal joint (near the rear of the ball of the foot). The distance, illustrated at 870, between the flat members 816 and 824 is adjusted so that it is equal to the distance 868. The foot 802 is then placed on the surfaces 818 and 826 with the mark 864 (or forward end of the heel 866) aligned with the hinge 832 so that the foot arch extends between the flat members 816 and 824, with the heel of the foot 802 resting on the flat member 816 and the ball of the foot 802 resting on the flat member 824, as illustrated in FIG. 30.

The difference in height, illustrated at 872, between the surfaces 818 and 826 when the foot 802 is in the optimum position (determined as discussed hereinafter) is the desired heel to forefoot height differential 716 for the footwear 800 as well as for boot 25. To test the foot 802 in different positions, one may start with the surface 818 level by moving the wedge 822 back and forth, as illustrated at 874, until surface 818 becomes level. One may also start by adjusting the height of flat member 824, by suitable addition of shims 828, until surface 826 is at the same height as surface 818. However, one may start at different positions. Then, as shims 828 are added or subtracted, balance and mobility and flexion are tested at each of different heights 872 by having the person roll the feet/ankles, forward flex, and the like, until he reports a height at which he feels that he has the best balance and mobility and flexion. In most cases, it is expected that this optimal height 872 is with the forefoot lower, as illustrated in FIG. 29, but it could be with the forefoot higher. The angle at this optimum height 872 is measured with the angle measuring device 876, which is a different way of measuring the heel to forefoot height differential 716 (FIG. 43), as discussed hereinafter.

Not only is it considered important to provide the optimum heel to forefoot height differential in the footwear 800, but it is also considered important for optimal balance and mobility and flexion that the heel angle, illustrated at 878, be optimal. In accordance with the present invention, in order to determine the optimal heel angle (the angle of the heel portion of the footboard), the wedge 822 is moved back and forth, as illustrated at 874, thereby changing the heel angle 878, the balance and mobility and flexion are tested at each of different heel angles 878 by having the person roll, forward flex, and the like, until he reports a heel angle 878 at which he feels that he has the best balance and mobility and flexion. This optimum heel angle 878 is also measured with the angle measuring device 876, as discussed hereinafter. The apparatus 804 is retained in the optimal position for heel to forefoot height differential and heel angle for use at that optimal position as discussed hereinafter. It should be understood that apparatus 804 may be embodied differently to provide a determination of optimal heel to forefoot height differential and heel angle, and such other embodiments of the apparatus 804 are meant to come within the scope of the present invention.

Figure 32:
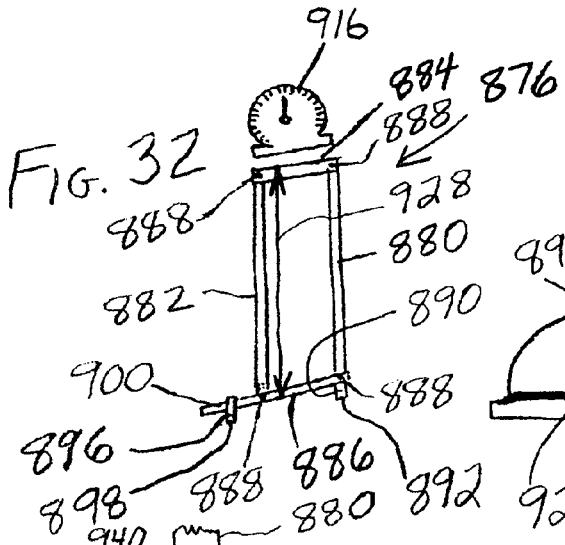
FIG. 32 is a side elevation view of a device for measuring the heel to forefoot differential and other footboard angles.

Referring to FIG. 32, the angle measuring device 876 comprises a pair of flat parallel bars 880 and 882 which will extend generally vertically during normal use and a pair of flat upper and lower parallel bars 884 and 886 respectively pivotally connecting the upper ends and lower ends respectively of bars 880 and 882 as by screws 888 or other suitable fasteners which allow the bars to pivot or rotate relative to each other. The screws 888 define pivot points. The distance between the upper pivot points is equal to the distance between the lower pivot points 888, and the distance between the left-side pivot points 888 is equal to the distance between the right-side pivot points 888. Each of the bars 880, 882, 884, and 886 may have, for example, a width of about ½ inch and a thickness of about 1/16 inch and be made of aluminum, steel, stainless steel, or other suitable material. The bars 880, 882, 884, and 886 are thus seen to form the shape of a parallelogram no matter in what position they are pivoted to. The vertical bars 880 and 882 do not extend beyond the bar 884 for reasons to be discussed hereinafter.

The vertical bar 880 extends downwardly beyond the lower bar 886 a short distance, illustrated at 891 (FIG. 29) of, for example, about ⅜ inch to define a portion 890 providing a first contact point, illustrated at 892, to engage one end of a surface whose angle is to be measured. The lower bar 886 extends beyond the other vertical bar 882 a distance, illustrated at 901 (FIG. 33), of, for example, about 3½ inches, thereby providing a portion 900 which supports a short vertically extending structure 896 which extends below the lower bar 886 a distance, illustrated at 894 (FIG. 29), which is substantially the same distance as distance 891 (FIG. 29), to provide a second contact point, illustrated at 898, to engage the other end of the surface whose angle is to be measured.

The structure 896 is adjustably movable along the length of bar portion 900 to adjust to the distance (between points 892 and 898) over which the angle of surface slope or incline (defined for the purposes of this specification and the claims as the angle of the differential between the heights of the surface at points 892 and 898) is to be measured.

As seen in FIG. 29, structure 896 comprises a flat bar which is bent to wrap around the top edge of portion 900 and to extend below the bottom edge of portion 900, and the resulting forward and rear portions are connected just below the bottom edge of portion 900 by screw or other suitable fastener 902 so that the structure 896 is adjustably movable along the length of portion 900 but tightly held in an adjusted position so that it does not inadvertently move from that position while making measurements. A cut-out (not shown) is provided in an end of the structure flat bar and the resulting tabs 904 on the lateral sides thereof are bent forwardly to engage the lateral sides of the structure flat bar to further secure it on portion 900.

Figure 37:
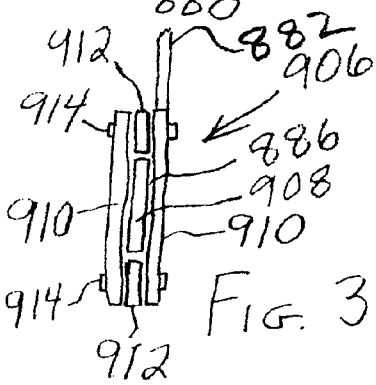
FIG. 37 is a partial end view of an alternative embodiment of the angle measuring device.

Referring to FIG. 37, there is shown generally at 906 an alternative form of the structure 896, wherein the end edge of bar 886 is illustrated at 908. Alternative structure 906 includes a pair of flat bars 910 which sandwich bar 886 and upper and lower shims 912 therebetween, the bars 910 and shims 912 held tightly together by upper and lower rivets 914 respectively so that, like structure 896, the structure 906 is adjustably movable along the length of portion 900 but tightly held in an adjusted position so that it does not inadvertently move from that position while making measurements. It should be understood that the angle measuring device 876 and the structures 896 and 906 may be otherwise suitably embodied, and such other embodiments are meant to come within the scope of the present invention as defined by the claims.

In order to determine the optimum heel to forefoot height differential for the foot 802 as determined by use of the apparatus 804 of FIGS. 29 and 30, the angle measurement device 876 is placed as illustrated in FIG. 29 with the points 892 and 898 engaging the flat members 816 and 824 respectively. Since the device flat bars 880, 882, 884, and 886 form the shape of a parallelogram no matter in what position they are pivoted to, the angle at which lower bar 886 extends is the same as the angle at which upper bar 884 extends, which means that the heel to forefoot height differential 872 can be determined by engaging a conventional inclinometer 916 along the length of bar 884 and reading from the inclinometer the angle of the slope or incline thereof. This of course requires that the member 810 provide a level surface, and to the extent that it doesn't, it may affect the accuracy of the measurement.

Figure 33:
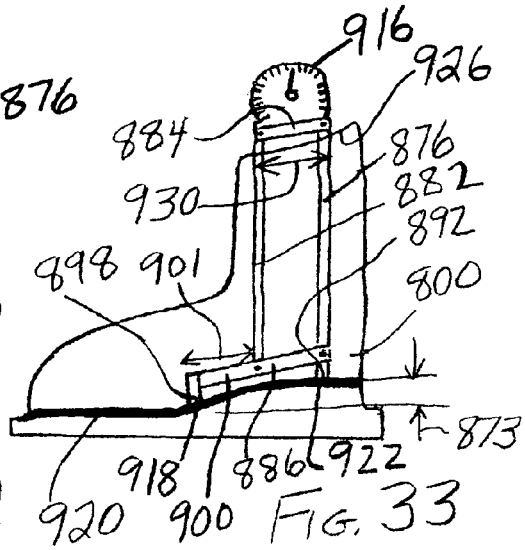
FIG. 33 is a schematic side view, from inside the boot, illustrating use of the angle measuring device to measure height differential.

The angle determined to be optimum for the heel to forefoot height differential with reference to FIGS. 29 and 30 is the angle which it is desired to provide for the heel to forefoot height differential in the footwear 800 for the foot 802. Referring to FIG. 33, there is illustrated the use of the angle measurement device 876 for determining the angle of the heel to forefoot height differential 873 in the footwear 800. Thus, the point 898 engages the point illustrated at 918 on the shoe footboard, illustrated at 920, that the metatarsal heads of the foot 802 rest upon, and the point 892 engages the point illustrated at 922 on the shoe footboard 920 that the heel of the foot 802 rests upon, it being important that the length between the points 892 and 898 be the same for the measurement in FIG. 33 as for the corresponding measurement in FIG. 29 and that the shoe 800 rest on a level surface to insure an accurate measurement.

Figure 34:
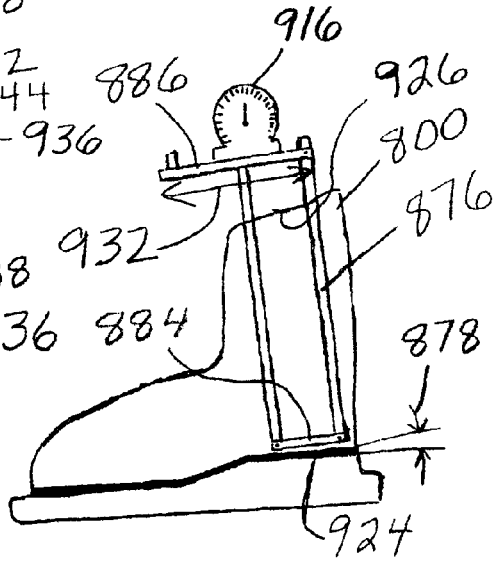
FIG. 34 is a view similar to that of FIG. 33 illustrating the angle measuring device inverted to measure the angle of the portion of the footboard upon which it rests.

Referring to FIG. 34, in order to determine the optimum heel angle 878 as determined by the apparatus 804 of FIGS. 29 and 30 and the heel angle 878 of the corresponding shoe 800, the angle measurement device 876 is turned upside down so that the upper bar engages over the length of the heel portion 924 of the shoe footboard 920 (the shoe 800 being shown in FIGS. 33 and 34 with the insole removed therefrom). Again, since the bars 880, 882, 884, and 886 define a parallelogram no matter in what position they are in and since bar 886 is thus parallel to bar 884, the angle 878 can be measured by engaging the inclinometer or angle indicator 916 along the length of bar 886 and read therefrom the angle, it again being important that the shoe 800 rest on a level surface to insure an accurate measurement.

It should of course be understood that the measurements for the apparatus 804 and corresponding measurements in the shoe 800 can be accurately compared as long as each measurement is obtained while the apparatus 804 and the shoe 800 are on the same or similarly inclined surfaces.

In order to unobstructively and conveniently make measurements inside typical shoes/boots, as illustrated in FIGS. 33 and 34, the vertical bars 880 and 882 are desirably long enough to extend above the top of the shoes/boots, and the upper bar is desirably short enough to fit within the shoe opening, illustrated at 926. In addition, the length of the lower bar 886 is desirably short enough that it can fit easily into the shoe/boot 800 while allowing sufficient adjustment of the distance between points 892 and 898. Accordingly, the length, illustrated at 928, of bar 882 is preferably at least about 9 inches, more preferably at least about 12 inches, with the bar 880 extending an added distance equal to the length 891 (in the range of about ¼ inch to ½ inch) of portion 890. The length, illustrated at 930, of bar 884 is preferably less than about 3 inches, for example, about 2½ inches. The length, illustrated at 932, of the lower bar 886 is preferably about 6 inches or less. While these dimensions are considered preferred for a typical shoe/boot, they may of course vary depending on shoe type/size.

Figure 35:
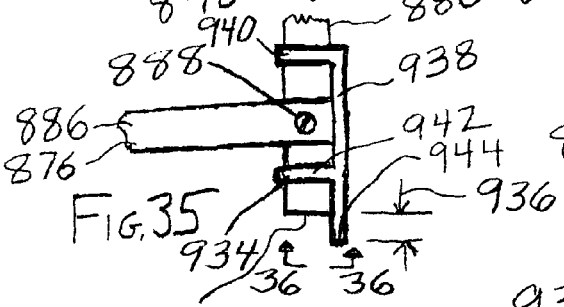
FIG. 35 is a side view of an attachment to the angle measuring device (the device shown partially) for determining difference height-wise between optimum and actual heel to forefoot differential.
Figure 36:
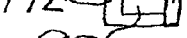
FIG. 36 is a bottom end view of the attachment, taken along lines 36-36 of FIG. 35.

Referring to FIGS. 35 and 36, there is shown at 934 an attachment to the angle measuring device 876 for determining the difference, illustrated at 936, between the determined (at 872 in FIG. 29) optimum heel to forefoot height differential and the determined (at 873 in FIG. 33) actual heel to forefoot height differential in a shoe 800 being or to be tailored for the optimum heel to forefoot height differential 872. The attachment 934 comprises an elongate bar 938 which extends vertically along side the lower portion of the vertical bar 880 and may be similarly sized in width and thickness. A pair of vertically spaced upper and lower sleeves 940 and 942 respectively are integral with or welded or otherwise suitably attached to the bar 938 and each being sized to tightly grasp the bar 938 but allowing the attachment 934 to be movable along the length thereof. The upper sleeve 940 is preferably attached to the upper end of bar 938. The lower sleeve 942 is spaced from the lower end of bar 938 which lower end defines a measuring point illustrated at 944. The attachment 934 may be suitably molded of plastic or suitably made of cast steel or other metal with the sleeves 940 and 942 suitably welded to the bar 938. The attachment 934 is mounted on the bar 880 before the bar 886 is attached to the bar 880 by screw 888. The spacing between the sleeves 940 and 942, for example, about 1 inch, is selected to allow the attachment 934 to be slid upwardly so that point 944 is even with (at the same height as) point 892 and to be slid from that position downwardly sufficiently to make the hereinafter described measurements.

To determine the amount of added thickness 936 needed in the shoe 800 (if such added thickness is needed) to achieve the determined optimum heel to forefoot height differential 872, the attachment 934 is slid upwardly until the points 934 and 892 are even with each other. While using inclinometer 916, the bar 886 is moved to the angle corresponding to the determined optimum heel to forefoot height differential 872 (the point 892 being above the heel), and the attachment 934 is slid downwardly until point 944 contacts the heel surface of the shoe 800. The distance 936 is then a measure of the added heel lift thickness needed in the shoe 800 to achieve the determined optimum heel to forefoot height differential 872.

Figure 43:
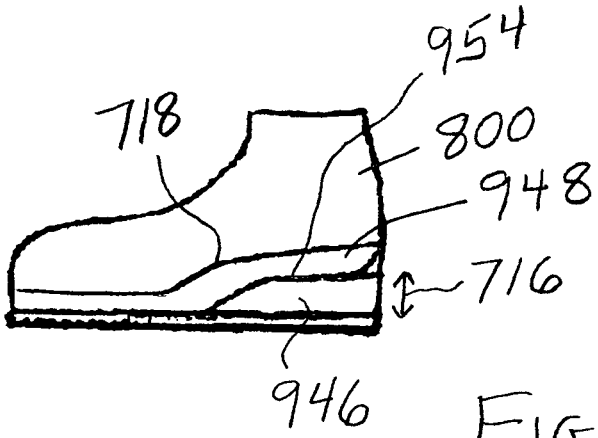
FIG. 43 is a schematic side view of a shoe with the footboard altered in accordance with the contour determined on the apparatus of FIG. 29 and with the insole having the foot impression placed therein.

Once the optimum heel to forefoot height differential 872 and heel angle 878 are determined, heel lifts of various thicknesses and tapers, as needed, as illustrated at 724 in FIG. 27 and as illustrated compositely at 946 in FIG. 43, are mounted in the shoe 800 to tailor the shoe to that optimum heel to forefoot height differential 872 and heel angle 878, utilizing the angle measurement device 876, as hereinbefore discussed, and utilizing principles commonly known to those of ordinary skill in the art to which the present invention pertains.

Figure 42:
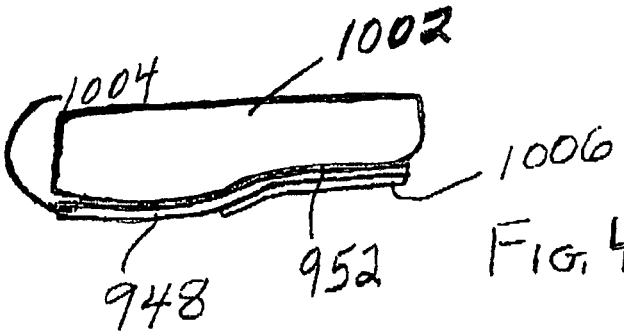
FIG. 42 is a side schematic view illustrating the transference of the foot impression from the cast form to an insole blank to form an insole having the foot impression.

After the heel is built up to the determined optimum heel to forefoot height differential 872 and heel angle 878, an insole, illustrated at 948 in FIGS. 42 and 43, is custom formed to fit the impression of the foot and suitably placed over the built-up heel 946 and forefoot, in a manner in accordance with the present invention, as discussed hereinafter, so that its upper surface conforms to the footboard 718. A custom insole is typically formed by forming an impression of the foot lower surface by placing the foot in a beaded bladder or other form such as casting foam and heating a custom insole blank and conforming it to the foot surface impression, then putting the cooled custom insole into the built-up shoe for the foot. Undesirably, the bottom surface of such a custom insole may not suitably correspond to the upper surface of the built-up sole. This is because, when the heel height and angle that the custom insole is placed upon is changed, unless the corresponding bottom surface of the insole is changed in the same way, the foot may undesirably be taken out of the desired subtalar neutral position, resulting in an unbalanced locked-up foot—the same type of condition which it is desired to avoid by the building up of the heel. In addition, the arch may no longer conform properly with the arch of such a custom insole, resulting undesirably in the arch of the person's foot being forced to change, again undesirably resulting in jammed foot bones.

In order to provide a footboard 718 suitably to prevent or reduce such misalignment or jamming of foot bones, in accordance with the present invention, the bottom surface of the custom insole 948 is conformed to the upper surface of the built-up sole 946 as described hereinafter.

Figure 41:
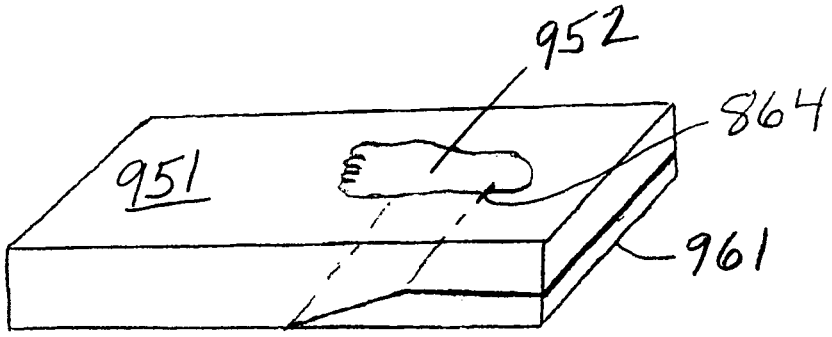
FIG. 41 is a view similar to that of FIG. 40 illustrating the casting of a cast form containing the foot impression.

Referring to FIG. 38, there is shown at 950 a rectangular (or otherwise suitably shaped) piece of casting foam in which, after it is altered to the form illustrated at 951 in FIGS. 40 and 41, the foot 802 is placed to form an impression, illustrated at 952, of the foot bottom, as illustrated in FIG. 40. A suitable casting foam is marketed as Treadeasy professional casting foam by Prime Materials Corporation of Batavia, N.Y. (see the earlier reference to the Treadway web site). In order to conform the upper surface 718 of the custom insole 948 to the upper surface 954 of the built-up sole 946, the lower surface of the casting block 950 must first be formed to the shape 951 of the built-up sole 946, i.e., formed to have the determined optimum heel to forefoot height differential 872 and heel angle 878 as well as arch length 870. If the foam block 950 is bent or mushed to attempt to form the shape 951, the impression may be distorted. Therefore, in order to suitably form the block 950 to achieve an undistorted shape 951 of the built-up sole 946, the shape is cut or severed from the block 950 as illustrated at 958. In order to do so, the lower surface 956 of the foam block 950 is suitably cut with a knife or other blade, illustrated at 963, to sever the portion illustrated at 961 and thereby form the lower surface 956 to have the determined optimum heel to forefoot height differential 872 and heel angle 878 as well as arch length 870.

Alternatively, the bottom surface 956 may be shaped by use of the apparatus illustrated generally at 960. The casting block 950 is received on a platform 962 one end portion of which is received within a frame 964 which has a bottom wall 966 and a pair of side walls 968 which extend above the platform 962. On each wall 968 are provided a pair of longitudinally spaced vertical slots, illustrated at 970, which allow the frame 964 to be height-adjustably attached to the platform 962 by wing screws 971 (or other suitable fasteners) received in the slots 970 and in corresponding threaded apertures (not shown) in the platform 962. This allows height adjustment of the frame 964 relative to the upper surface of the platform 962 (for example, from flush with the platform upper surface to about 1 inch above the platform upper surface) thereby vertically positioning a blade 972 received in tracks or grooves 974 in the inner surfaces of the side walls 968 for pushing longitudinally, as illustrated at 976, to make the cut in the foam block 950 which is illustrated at 978, to correspond to the determined optimum heel to forefoot height differential 872. The longitudinal spacing of the slots 970 allows the corresponding longitudinal spaced portions of the frame 964 to be adjusted to different heights to thereby tilt or incline the tracks 974 so that the cut 978 can be made at an angle corresponding to the determined heel angle 878.

In order to form the cut illustrated at 980 in the foam block 950, a fixture 982 is mounted on one side of the platform 962. A portion 984 of the fixture 982 is mounted to the platform 962 by a wing screw 986 (or other suitable fastener) received in an aperture, illustrated at 988, in the portion 984 and threadedly received in a nut (not shown) which is held in a longitudinally extending T-slot, illustrated at 990, which allows the fixture 982 to be adjustably positioned along the length of T-slot 990 as needed for the determined length 870 of the arch. The fixture 982 has a portion 992 normal to portion 984 which supports a pair of lips 994 between which a blade or cutter 996 is receivable thereby providing a track for holding and guiding the blade 996 for its movement crosswise of the platform 962, as illustrated at 998, for making the cut 980 of the desired length 870. It should be noted that the fixture 982 is rotatable about wing screw 986 so that the track 994 is adjustably inclined to conform to the desired angle of the cut 980. During the making of the cut 980, an edge portion 1000 (opposite from the edge portion received in the track 994) of the blade 996 may rest on the end portion of the blade 972 when blade 972 is pushed all the way in. It should of course be understood that the present invention is not limited to the apparatus and process for making the cuts 958 and 980 as disclosed herein, and other embodiments thereof are meant to come within the scope of the present invention as defined by the appended claims.

Figure 31:
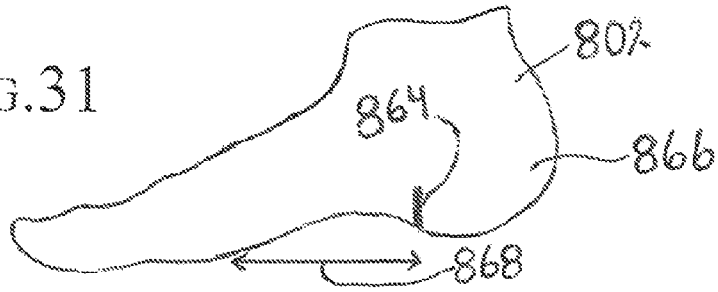
FIG. 31 is a side view of the foot marked for placement on the apparatus.

Referring to FIG. 40, the formed block 951 is placed on the measuring device 804 (shown in FIGS. 29 and 30 and illustrated schematically in FIG. 40). If not already placed as discussed with reference to FIG. 31, the mark 864 is placed on the foot 802 at the forward end of the heel, and the foot 802 is pressed or caused to sink into the altered casting foam 951 with the mark 864 lined up with the hinge 832, so that the foot arch extends between the flat members 816 and 824, and with the foot 802 in a subtalar position well known to podiatrists and others of ordinary skill in the art to which the present invention pertains. The forward end of the impression is illustrated at 953. Alternatively, a measuring device could be used while using apparatus 804 (FIGS. 29 and 30) to indicate the forward end of the heel and this mark location used for aligning the altered foam block 951 and the foot 802. The foot 802 may be aligned with the apparatus 804 in other suitable ways. In this way, the forefoot is pressed further into the foam 951 than the heel is pressed (since member 824 offers resistance at a lower height than member 816 does) thus to thereby recreate the determined optimum heel to forefoot height differential 872 and heel angle 878 as well as arch length 870, as seen in FIG. 40, whereby the impression 952 of the foot bottom may be made at the optimum heights and angles.

Referring to FIG. 41, the altered foam block 951 carrying the foot bottom impression 952 may now have the severed portion 961 matched therewith and put back in the box the foam block 950 came in (or the altered foam block 951 otherwise suitably leveled as desired) and plaster of paris or other suitable casting material poured into the space containing the foot bottom impression 952 and allowed to harden. The resulting cast block, shown at 1002 in FIG. 42, containing the foot bottom impression 952 is suitably removed from the foam block 951.

It should of course be understood that other suitable means such as, for example, a beaded bladder, may be used to form the foot bottom impression, and such other means are meant to come within the scope of the present invention as defined in the appended claims.

A suitable insole blank 948 (which may typically be a generally flat sheet having a generally uniform thickness and which may have a softer or more flexible or cushion-like upper portion 1004 over its length and a more rigid lower portion 1006 over generally the heel and arch areas to hold the form thereof, although the lower portion 1006 may extend all the way to the toes) is suitably heated (placed in hot water or otherwise as suitable) to a suitable temperature as may be recommended by the manufacturer (for example, about 180 degrees F.). The heated blank 948 is then placed on the foot bottom impression surface 952 of the cast block 1002 and allowed to conform thereto and cool, thereby to desirably conform the thusly tailored insole 948 to the upper surface of the built-up sole as well as to the foot. The tailored insole 948 is then placed in the shoe 800 over the built-up sole 946 to thereby achieve an insole surface which conforms to the surface of the built-up sole so that the built-up sole and conforming insole are both contoured to optimize balance and/or mobility and/or flexion.

As previously discussed, the heel height of a ski boot is adjusted along with providing a optimum bootboard contour in the boot in order to optimize balance and/or mobility and/or flexion while skiing.

In accordance with the present invention, a line of shoes or other footwear is marketed wherein each shoe size (currently sized in length and width) is also sized in various increments of heel to forefoot height differentials 872 and may be further sized in various increments of heel angle 878 and/or arch length 870. The customers would be sized utilizing the principles disclosed herein. In order to reduce shopkeeper inventory, the manufacturer may sell to the shopkeeper as the orders are received and may wait to make a particular sized shoe until the order is received.

It should be understood that, while the present invention has been described in detail herein, the invention can be embodied otherwise without departing from the principles thereof, and such other embodiments are meant to come within the scope of the present invention as defined by the appended claims.

What is claimed is:

1. A method of tailoring a shoe for a foot of a person, the method comprising positioning the foot to rest two surfaces interconnected by an intermediate structure, so that the heel of the foot rests on a first of the surfaces and the forefoot of the foot rests on a second of the surfaces with the foot arch extending between said first and second surfaces and over said intermediate structure, for each of heights of the first surface relative to the second surface, the intermediate structure configured to selectively fix the relative positions of the first and second surfaces, incrementally raising one of the first and second surfaces relative to an other of the first and second surfaces thereby positioning the foot in a range of incremental heel to forefoot height differential positions for measurement outside of the shoe of heel to forefoot height differential, testing for mobility and/or flexion and/or balance of the foot at each of the height differential positions by having the person place the foot onto the surfaces at each of the height differential positions until the person reports one of the height differential positions at which the person feels that the person has the best balance and/or mobility and/or flexion, selecting said one of the height differential positions to be the incremental heel to forefoot height differential position which is determined for the foot by the testing to be optimum for mobility and/or flexion and/or balance, altering the sole of the shoe to have a heel to forefoot height differential along the foot-engaging surface of the sole which matches the selected heel to forefoot height differential position which is determined for the foot by the testing to be optimum for mobility and/or flexion and/or balance, and forming an insole for the shoe which conforms to the altered sole.

* * * * *